US011640816B1

(12) United States Patent
Mathur

(10) Patent No.: US 11,640,816 B1
(45) Date of Patent: May 2, 2023

(54) METAMATERIAL ACOUSTIC IMPEDANCE MATCHING DEVICE FOR HEADPHONE-TYPE DEVICES

(71) Applicant: Acoustic Metamaterials LLC, Scarsdale, NY (US)

(72) Inventor: Gopal Prasad Mathur, Trabuco Canyon, CA (US)

(73) Assignee: Acoustic Metamaterials LLC, Scarsdale, NY (US)

( * ) Notice: Subject to any disclaimer, the term of this patent is extended or adjusted under 35 U.S.C. 154(b) by 0 days.

(21) Appl. No.: 17/824,995

(22) Filed: May 26, 2022

Related U.S. Application Data

(60) Provisional application No. 63/268,381, filed on Feb. 23, 2022.

(51) Int. Cl.

| | |
|---|---|
| ***G10K 11/04*** | (2006.01) |
| ***G10K 11/02*** | (2006.01) |
| ***H04R 1/28*** | (2006.01) |
| ***H04R 1/10*** | (2006.01) |

(52) U.S. Cl.
CPC ..... *G10K 11/04* (2013.01); *H04R 1/1091* (2013.01); *H04R 1/28* (2013.01); *H04R 2460/09* (2013.01)

(58) Field of Classification Search
CPC ..... G10K 11/04; G10K 11/02; H04R 1/1091; H04R 1/28; H04R 1/2803; H04R 1/2807; H04R 1/2823; H04R 1/2826; H04R 1/2846; H04R 1/2849; H04R 1/2853;
(Continued)

(56) References Cited

U.S. PATENT DOCUMENTS 2,880,817 A * 4/1959 Burns ..... H04R 1/2811 381/349
3,157,750 A * 11/1964 Weingartner ..... H04R 1/225 381/373

(Continued)

FOREIGN PATENT DOCUMENTS

AU 2020343462 A1 * 3/2022 ..... H04R 1/24
FR 2941122 A1 * 7/2010 ..... H04R 1/2826

(Continued)

*Primary Examiner* — Edgardo San Martin
(74) *Attorney, Agent, or Firm* — Michael J. Feigin, Esq.; Feigin and Fridman LLC

(57) ABSTRACT

An acoustic metamaterial (AMM) passive impedance matching device for headphone-type devices for matching the complex acoustic impedance load of a human ear to enhance acoustic performance of a headphone is disclosed. The device includes shunt compliance chambers stacked concentrically relative to one another from an upper end to a lower end. Each of the shunt compliance chambers includes side connecting inductive channels positioned annularly around a circumference of at least one of the shunt compliance chambers. The shunt compliance chambers define a predetermined volume of air. The inductive channels connect the shunt compliance chambers to the main headphone volume, generating an acoustic resistance and reactive impedance that matches the complex acoustic impedance load of the human ear canal. The AMM device also includes an inductive channel, as a design parameter, extending from the main headphone volume to the ambient air serving as an additional resistive and reactive load.

15 Claims, 15 Drawing Sheets

(58) Field of Classification Search
CPC ..... H04R 1/2857; H04R 1/30; H04R 1/34; H04R 1/345; H04R 2460/09
See application file for complete search history.

(56) References Cited

U.S. PATENT DOCUMENTS

| | | | | | |
|---|---|---|---|---|---|
| 4,079,198 | A * | 3/1978 | Bennett | G01H 15/00 | 73/648 |
| 4,152,555 | A * | 5/1979 | Modena | H04R 29/004 | 379/27.01 |
| 4,763,753 | A * | 8/1988 | Killion | A61B 5/12 | 381/328 |
| 4,807,612 | A * | 2/1989 | Carlson | A61F 11/08 | 128/868 |
| 5,012,890 | A * | 5/1991 | Nagi | H04R 1/2826 | 381/353 |
| 5,261,006 | A * | 11/1993 | Nieuwendijk | H04R 1/345 | 381/345 |
| 5,793,000 | A * | 8/1998 | Sabato | H04R 1/025 | 181/182 |
| 7,740,104 | B1 * | 6/2010 | Parkins | A61F 11/08 | 181/129 |
| 8,107,665 | B2 * | 1/2012 | Haapapuro | H04R 1/1016 | 381/370 |
| 8,351,629 | B2 * | 1/2013 | Parker | H04R 1/2857 | 381/345 |
| 9,456,266 | B2 * | 9/2016 | Johansen | H04R 31/00 | |
| 10,182,287 | B2 * | 1/2019 | Struzik | H04R 1/2888 | |
| 10,475,435 | B1 * | 11/2019 | Dominijanni | H04R 1/1041 | |
| 11,026,017 | B2 * | 6/2021 | Mäkivirta | H04R 1/24 | |
| 11,265,645 | B2 * | 3/2022 | Pavlov | H04R 1/2849 | |
| 11,323,798 | B1 * | 5/2022 | Mathur | H04R 1/2803 | |
| 2015/0124978 | A1 | 5/2015 | Johansen et al. | | |
| 2017/0251297 | A1 * | 8/2017 | Darlington | G10K 11/17885 | |
| 2020/0178003 | A1 * | 6/2020 | Zurbruegg | H04R 1/1016 | |
| 2020/0204929 | A1 * | 6/2020 | Zurbruegg | H04R 25/453 | |
| 2021/0400401 | A1 * | 12/2021 | Zurbruegg | H04R 25/456 | |
| 2022/0079813 | A1 * | 3/2022 | Lawrence | G10K 11/162 | |

FOREIGN PATENT DOCUMENTS

| | | | | |
|---|---|---|---|---|
| WO | WO-9119406 | A1 * | 12/1991 | H04R 1/30 |
| WO | WO-2021156357 | A1 * | 8/2021 | |

* cited by examiner $$C_n = \frac{V}{rc^2} = C_a$$

$$Z_c = \frac{rc}{A}$$

$$M_{ad} = C_n Z_c^2$$

The acoustical impedance of the acoustical system is $$z_{A2} = r_A + j\omega M + \frac{1}{j\omega C_A}$$

where $r_A$ = acoustical resistance, in acoustical ohms,
$M$ = inertance, in grams per (centimeter)$^4$, and
$C_A$ = acoustical capacitance, in (centimeter)$^5$ per dyne.

$$C_a = \frac{V}{\rho c^2}$$

$$f_r = \frac{1}{2\pi}\sqrt{\frac{1}{M_a C_a}} = \frac{c}{2\pi}\sqrt{\frac{S}{LV}}$$

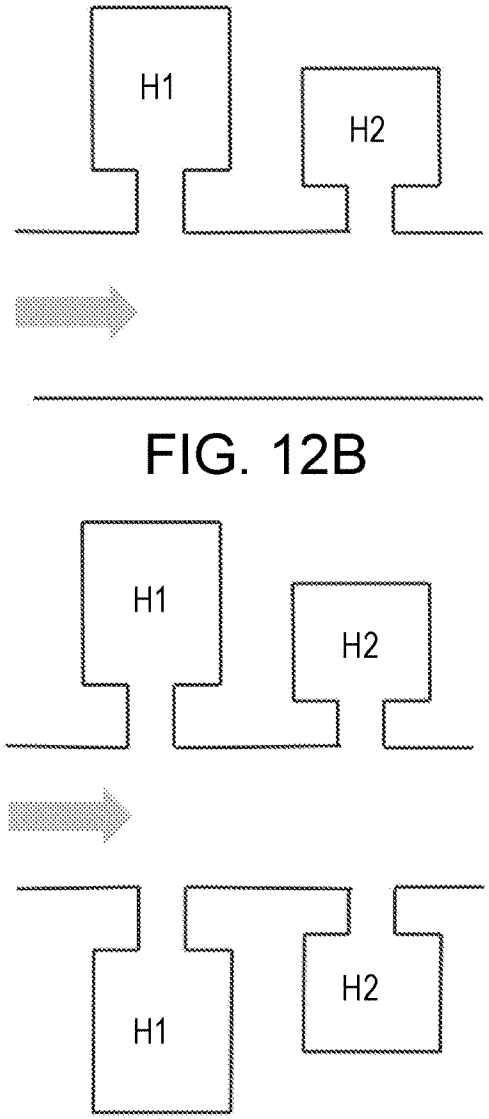
FIG. 12B
FIG. 12C
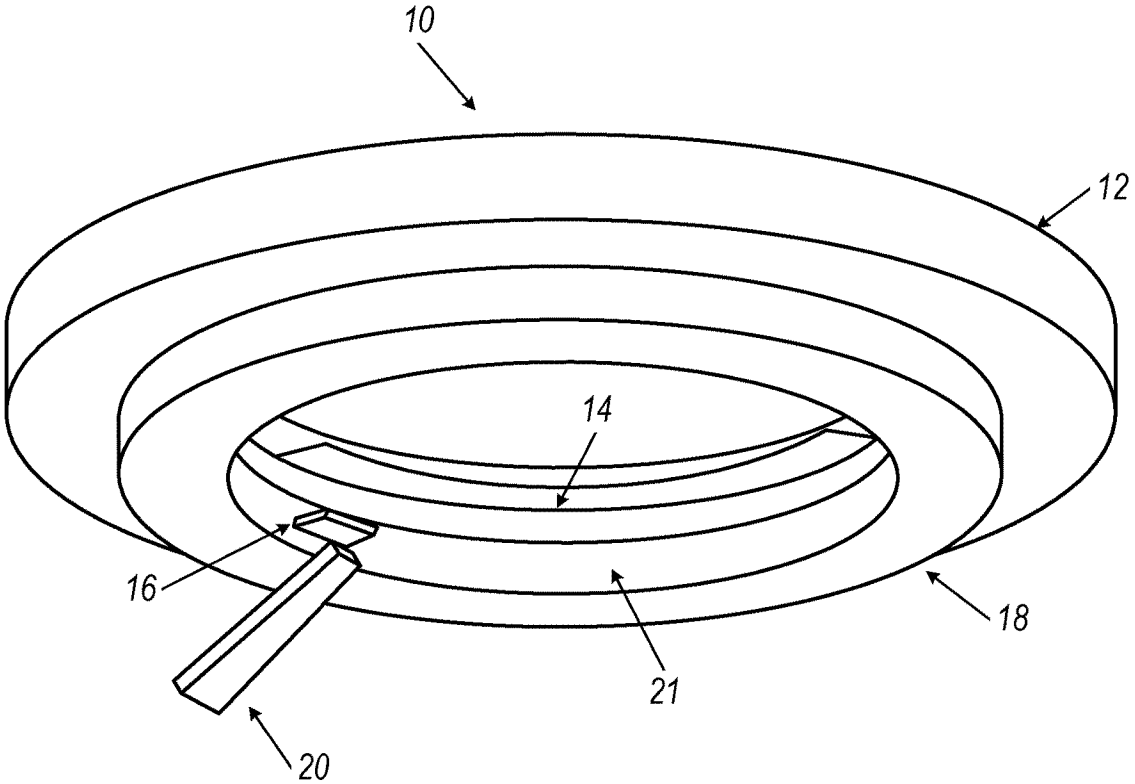
FIG. 12A

METAMATERIAL ACOUSTIC IMPEDANCE MATCHING DEVICE FOR HEADPHONE-TYPE DEVICES

FIELD OF THE DISCLOSED TECHNOLOGY

The disclosed technology relates generally to a passive impedance matching device for efficient sound radiation into a human ear from headphone-type devices. More specifically, the disclosed technology is related to enhancing sound radiation into a human ear by external devices such as, headphones, headsets, ear buds, hearing aids, and the like, by achieving passive acoustic impedance matching of sound radiation into a human ear using an acoustic meta material (AMM) approach.

BACKGROUND OF THE DISCLOSED TECHNOLOGY

A headphone is a device that features two interconnected drivers worn on a user's head. With wired over-the-head headphones, the drivers are connected by a headband and worn over the head. With wired earbud headphones, the drivers are connected by a cable. With wireless earbuds, the drivers are interconnected via pairing, such as with Bluetooth. The term headphone is used generically to encompass all the other terms or devices including a pair of interconnected earphones for listening to audio signals such as music or speech. Headsets, a type of headphone, are basically headphones with microphones. Headphones are also known as ear-speakers, earphones, ear buds, etc., as shown in FIG. 1.

Ear buds are small devices, which fit directly into the ear canal. Earphones can be anything and everything else. In-ear headphones are just a synonym for ear buds.

The ear is one of the most complex organs in the human body. Sound is a sequence of pressure waves, which propagates through a compressible media such as air. The way the human ear/auditory system works is incredibly complicated and requires a number of functions to work properly, including: (i) Sound is transmitted through the air as sound waves from the environment. (ii) The sound waves are gathered by the outer ear and sent down the ear canal to the eardrum. (iii) The sound waves cause the eardrum to vibrate, which sets the three tiny bones in the middle ear into motion. (iv) The motion of the three bones causes the fluid in the inner ear, or cochlea, to move. (v) The movement of the fluid in the inner ear causes the hair cells in the cochlea to bend. The hair cells change the movement into electrical impulses. (vi) These electrical impulses are transmitted to the hearing (auditory) nerve and up to the brain, where they are interpreted as sound.

Referring to FIG. 2, the outer ear has a visible part, called the pinna, and the canal. The pinna collects and funnels the sound down the canal to the tympanic membrane (eardrum). The canal is made up of only a few layers of skin and small hairs.

The tympanic membrane, or eardrum, divides the outer and middle ear. The middle ear is an air-filled cavity that is also connected to the back of the nose through the Eustachian tube. There are three small bones in the middle ear called ossicles. These tiny bones are called the malleus, incus, and stapes and they form a connected chain in the cavity from the eardrum to the inner section. The ossicles relay mechanical vibrations that are received at the tympanic membrane to the oval window, which is the beginning of the cochlea.

The inner ear has two main structures: 1) the semicircular canals and 2) the cochlea. The human ear canal couples the external sound field to the eardrum and the other parts of the middle ear. Therefore, knowledge of the acoustic impedance of the human ear is necessary to develop audio devices such as smartphones, headsets, and hearing aids.

Dimensionally, the largest feature of the human ear with some acoustic consequence is the ear canal, which is approximately 25 mm in length, and 7 mm in diameter with a corresponding quarter-wavelength resonance near 2.5 kHz with an approximate pressure gain of about 10 dB. The adult external auditory canal (EAC) is divided into an outer one-third cartilaginous portion and an inner two-thirds bony portion. The overall length is approximately 2.5 cm. The isthmus is a bony-cartilaginous junction and corresponds to the narrowest point of the external auditory canal, which is situated at the junction of the outer one-third of the inner two-thirds of the canal. Besides sound transmission, the external ear canal performs a critical modification. Due to its shape and dimension, sounds in the 3000 Hz region resonate and are amplified. The overall modification effect of the outer ear is a 10-15 dB amplification of sound in the 2 kHz to 4 kHz range.

The next larger feature of the ear is the concha with a height, on average, of 19 mm, a width of 16 mm and a depth of about 10 mm. There is significant individual variation in these dimensions with very little correlation between them or with other pinna dimensions. The depth mode resonance in the 4-5 kHz range, results in a pressure gain of about 10 dB. Both the canal and concha-depth resonances are complementary effects and are approximately independent of angle of the free-field sound and produce a pressure gain that starts at about 1.5 kHz reaching a maximum gain of up to 20 dB near 3-4 kHz and then decreasing again. At frequencies above 5 kHz, the width and depth modes of the concha become important, and excitation of these modes is dependent on the angle of incident sound (Shaw and Teranishi 1968; Teranishi and Shaw 1968).

The delicate tympanic membrane is located at the end of the long ear canal deep inside the skull likely for protection from mechanical damage. At frequencies above approximately 1 kHz the membrane response is very complex, while the cochlea provides a mainly resistive load. This resistive load is the primary damping factor of the external ear resonances.

The ear canal is filled with air that is continuous with the free field. On the other hand, the cochlea is filled with cerebrospinal and other salty fluids. A displacement on any part of the eardrum is reflected in a compression of air enclosed in the middle-ear cavities. It may sometimes be assumed that the ear-canal pressure is nearly independent of the ear to which the earphone is coupled.

Measurements of the impedance of the middle-ear air space on human ears with intact mastoid air spaces show a compliance-dominated impedance for frequencies lower than about 500 Hz and magnitudes with multiple extrema at higher frequencies. Researchers have shown that variations in middle-ear air space impedance do affect the impedance at the tympanic membrane for frequencies above 1000 Hz.

Earphone design process often involves selecting receivers, style and dimensions of sound tubes, and damping used in the tubes. Currently, this is largely a trial-and-error process in the field, especially when multiple drivers are used. The response characteristics of current earphone designs thus heavily rely on designers' experiences.

With the advancement of digital technology and the ever-lasting trend of shrinking hardware size portable communication and entertainment equipment, e.g., cell phones, smart phones, MP3 players, and portable DVD players, become more and more popular as well as multi-functional. As is well known, earphones play an essential role in using and enjoying the convenience and versatile functions provided by those personal communication and entertainment equipment. Since the criterion for sound perception is highly subjective, it may vary from person to person, thus different customers' preferences and needs have led to numerous earphone designs on the market. Furthermore, customers are constantly demanding new earphone products with either novel or unique designs.

The performance, or more properly the subjective sound quality, of an insert earphone depends on various parameters including, inter alia, the sound driver(s), the tubing structure attached to the driver(s), and the shape and dimensions of the housing. Currently dynamic speakers and balanced armature (BA) speakers (or receivers) are commonly used in earphone designs. There are two apparent differences between these two speakers. On one hand, dynamic speakers are generally much larger than BA speakers. Simply speaking, 10 mm may be considered as on the low end in terms of the size (i.e., diameter) of a dynamic speaker, while it is probably the largest size for BA speakers. On the other hand, dynamic speakers are easier to manufacture, thus are usually significantly more cost effective than BA speakers. For the same reason, dynamic speakers generally find wider applications in earphone designs, especially in the mid- to low-end market.

Traditionally, the driver can be selected based on the criterion of matching its frequency response to the shape of the target design curve as much as possible. Then the tube and associated damping values are chosen to adjust the earphone response curve by introducing extra dynamics into the acoustic system. This is highly a trial-and-error process, especially when multiple driver designs are involved. It is often hoped to have a simulation model to aid the design process. The driver is the most important unit in headphones. That's because it's the component that converts electrical signals into sound. In other words, it creates the sound we hear. Headphone drivers are tiny loudspeakers inside listeners' ears.

Dynamic (moving coil) drivers are the simplest configuration of all driver types that are used. They use a magnet, typically a neodymium magnet, whose magnetic field interacts with the voice coil. With current running through it, the voice coil begins to oscillate, prompting the diaphragm to do so as well, following the same rhythm. This oscillation of the diaphragm moves air in front, producing sound waves.

Balanced armature drivers are very small drivers, and their typical use is with in-ear monitors. Due to their size, manufacturers will put multiple drivers in a single earpiece. Typically, most in-ear monitors come with one to four drivers. Using more drivers in a single earpiece allows these earphones to reproduce different frequencies with minimal distortions. An individual driver usually handles bass notes, while the remaining ones deal with the rest of the musical frequencies. One downside of balanced armature drivers compared with dynamic ones is that they have difficulty reproducing the bass response. This is why it's not uncommon for some in-ear headphones to include multiple balance armature drivers and a dynamic one, as the latter makes up for the lack of bass response.

Sound waves entering the ear travel through the external auditory canal before striking the eardrum and causing it to vibrate. The ear canal, specifically, amplifies sound in the high frequencies (for an adult, typically in the region between 2000-4000 Hz). The exact amount of amplification, the ear canal resonance, is particular to the individual and depends on, for example, the length, volume and curvature of the canal. In general, the smaller the ear canal, the more amplification in the higher frequencies.

All loudspeakers require some form of isolation of sound energy that will radiate off the speaker backside. Baffles or some sort of enclosure is needed to maintain and define low frequency output. Enclosures are a way to implement infinite baffle on a loudspeaker. Loudspeaker enclosure can be thought of as a baffle wrapped around it on the backside. Thus, a loudspeaker enclosure contains all the back radiation, which would have otherwise radiated away, as well as its own modal characteristics imposed on it. The enclosure will obviously influence loudspeaker's front radiation.

The task of the earphone is somewhat simpler than that of the loudspeaker, and the construction of an earphone that can provide acceptable quality of sound is very much simpler (and correspondingly cheaper) than that of a loudspeaker, since the earphone can use a small diaphragm, and ensure that the sound waves from this diaphragm are coupled directly to the ear cavity. The power that is required is in the low milli-watt level, and even a few milli-watts can produce considerable pressure amplitude at the eardrum—often more than is safe for the hearing.

A loudspeaker, by contrast, has its sound waves radiated into an open space whose properties are unknown, and it must be housed in a cabinet whose resonances, dimensions and shape will considerably modify the performance of the loudspeaker unit. The assembly of a loudspeaker and cabinet will be placed in a room whose dimensions and furnishing are outside the control of the loudspeaker designer, so that a whole new set of resonances and the presence of damping material must be considered.

It is well known that when the acoustic impedances of the two media are very different, most of the sound energy will be reflected (or absorbed), rather than transferred across the boundary.

The outer ear collects the sound energy and sends it toward the tympanic membrane (TM). When a sound signal reaches the TM, part of its energy is transferred to the middle ear and the rest gets reflected back toward the outer ear. The amount of reflection and transmission depends on the difference between the impedances of the outer ear and the middle ear. These impedances are the measures of opposition/impediment that the outer ear and the middle ear impose on a pressure wave that travels through them.

Apart from the electromechanical impedance, a loudspeaker driver, on the front side, is subjected to radiation impedance of the ambient medium, i.e., waveguide in the front. When the radiated sound wave from the high impedance of the loudspeaker driver reaches the transition of reactive dominated impedance in the ear canal, there is a strong probability that significant portion of the power in the incident wave will be reflected, rather than transmitted into the ear. For maximum power transmission to be achieved, an intermediate matching impedance device between the two regions is needed.

The acoustic impedance of the ear canal cavity represents its "opposition" to the volume velocity transfer and governs its reaction in terms of acoustic pressure. Ear canal simulators or couplers are normally used to simulate the acoustics of a standard human ear canal. Couplers are extensively used in hearing aid development to test and measure the performance of new designs and are used to represent ear canals on a variety of acoustic manikins for 3D sound recording or testing of headphones and ear buds.

The input impedance of a circular tube with a rigid termination is given by:

$$Z_c=R_c+jX_c,$$

$$R_c=0,$$

$$X_c=-j(\rho c/S_c)\cot kL_c,$$

where $S_c$ is cross-sectional area and $L_c$ is length.

The impedance of an un-baffled rectangular waveguide of (2a is diameter or larger dimension) is as follows:

$$z_t=\rho_0 c[(ka)^2+j(0.6ka)]$$

for ka<<1.

The external auditory canal (EAC) is slightly sinuous, being about 2.5-3.0 cm long in adults, from its opening up to the tympanic membrane. It is a tube with an open end (concha portion) and a closed end (tympanic membrane), which behaves as a resonator from a quarter-wave, with the resonance frequency being represented by the equation $f_r$=c/4L, where "c" is the speed of sound and "L" the length of the EAC. The resonance of the canal occurs at a frequency range of 2,700 Hz, with amplitude between 10 and 20 dB, and these frequencies are essential for speech recognition.

The occlusion effect occurs when an object fills the outer portion of a person's ear canal, causing that person to perceive echo-like "hollow" or "booming" sounds generated from their own voice. The acoustic impedance of the ear canal cavity represents its "opposition" to the volume velocity transfer and governs its reaction in terms of acoustic pressure. In other words, the occlusion effect is mainly due to the increase of the acoustic impedance of the ear canal cavity when it is occluded. Venting typically affects frequencies below 1000 Hz. In general, the larger the vent, the more low-frequency energy is 'drained off' By using different vent diameters, varying amounts of low-frequency amplification can be reduced. How much sound leaves and how much stays inside the ear bud? The proportion leaving depends on the impedance of the escape route relative to the impedance of the residual canal and middle ear. The vent/leakage pathway, being an acoustic mass, has impedance that rises with frequency. Conversely, the residual ear canal volume, being primarily an acoustic compliance, has impedance that falls as frequency increases. For both these reasons, the vent becomes more attractive as an escape route as frequency decreases. Consequently, for sounds injected into the ear canal by the amplifier and driver, the vent provides a low cut to the frequency response. The extent of the low-frequency cut depends on the size of the vent (because the vent size determines its acoustic mass or reactance).

WIPO Publication No. Pub. No.: US 2015/0124978 A1 by Johansen et al (hereinafter "Johansen") relates to an ear simulator representing an average acoustic eardrum impedance of ears of a population of humans. The main aspect of the invention relates to an ear simulator assembly comprising an ear simulator representing average acoustic ear drum impedance and a detachable ear canal simulator to provide an ear simulator assembly representing an acoustic impedance of a human ear canal or average human canals of the population. The ear simulator by Johansen is used for simulation of human ear impedance for testing and designing hearing aid and headphone type devices. However, this invention is not used to enhance performance of the devices by incorporating its design inside the devices. It may be mentioned that this (e.g., "Johansen") invention is an external stand-alone, laboratory-testing device.

Recently, Mathur has proposed a passive acoustic impedance matching device to maximize sound power transmission over a broadband frequency range from the loudspeaker to ambient medium based on acoustic metamaterial approach [U.S. patent application Ser. No. 17/539,304 (2021)].

Radiation resistance represents the energy lost by the piston and/or loudspeaker. Indeed, the radiation resistance determines the amount of power, which propagates into the medium. On the other hand, the imaginary part, the radiation reactance/compliance, represents the amount of energy stored in the medium in the vicinity of the piston to facilitate this propagation.

Metamaterials are broadly defined as artificial composite materials specifically engineered to produce desired unusual properties not readily available in nature. Accordingly, there is a need for a passive impedance matching device for enhancing acoustic performance of devices such as headphones, ear buds, earphones, etc., by achieving impedance matching of sound radiation of these devices that are coupled and/or inserted into the human ear canal.

SUMMARY OF DISCLOSED TECHNOLOGY

The present disclosed technology provides an acoustic metamaterial (AMM) passive impedance matching device and system, designed to provide optimum impedance for sound radiation from the headphone type devices in to the human ear to significantly improve their broadband acoustic performance and to overcome the adverse complex impedance load presented by the ear. The AMM device includes a combination of resistive, inductive and capacitive acoustic elements to match the resistive and reactive features of the impedance load of a human ear canal. A combination of resistive and a reactive impedance including inductive and capacitive elements in the transmission line model may be used for enhancing the performance of a headphone (or a similar device) over a given broad band frequency range. Passive management of acoustics of the human ear canal impedance inside the headphone device can thus be achieved with various compatible configurations of the AMM impedance device.

In some embodiments, the acoustic metamaterial passive impedance matching devices, include a combination of slits and shunt volumes around or inside the main headphone device and attached to the device itself in shunt configuration, generating a complex acoustic impedance that matches the acoustic impedance of the human ear. A side shunt vent representing inductive and resistive impedance of ear canal is also included for frequencies below 1000 Hz.

In embodiments, a pluratity of side shunt volumes include a plurality of slit/channels placed after the loudspeaker driver and connected to the main volume of the device. The plurality of shunt volumes and the plurality of slits/channels are designed in conjunction with the ear canal characteristics.

In other embodiments, there may be plurality of slits/channels connecting enclosed shunt volumes to provide necessary inductive reactance.

In some embodiments, plurality of shunt volumes match with respect to each other and with the plurality of slits/channels.

In some embodiments, the number of slits/channels per shunt volume may be different, such that the topmost volume includes more slits while the lowermost volume includes the least slits.

In certain embodiments, the quantity of shunt volumes and the number of slits/channels are functions of the acoustic impedance of the human ear.

In other embodiments, the dimensions of the volumes and side slits/channels are a function of the acoustic impedance and reactance of the human ear.

In some embodiments, the shunt volumes increase in diameter from the upper end to the lower end, such that the volume furthest from the loudspeaker includes the smallest diameter and the volume closest to the loudspeaker driver includes the largest diameter.

In some embodiments, the volumes are uniform in diameter from the upper end to the lower, such that the volumes include substantially equal diameters.

In certain embodiments, the lower end of the baffle includes a vent tube for relieving the pressure of the ear canal.

The complex acoustic impedance, Z, is defined as $$Z=R+jX$$

where, R is the resistive part, and X is the reactive part of the impedance. The resistive component is associated with friction and the energy losses caused by the sound radiation/propagation of an acoustic system; the reactive component is associated with the reactions of forces of inertia (masses) or elasticity (compliance).

"Metamaterial" refers to "any material engineered to have a property that is not found in naturally occurring materials, which may be made from assemblies of multiple elements fashioned from composite materials such as metals and plastics". "Impedance" refers to "the effective resistance of an electric circuit or component to alternating current, arising from the combined effects of ohmic resistance and reactance." "Inductance" refers to "the property of an electric conductor or circuit that causes an electromotive force to be generated by a change in the current flowing." "Resistance" refers to "the degree to which a substance or device opposes the passage of an electric current, causing energy dissipation." "Capacitance" refers to "the ratio of the change in an electric charge in a system to the corresponding change in its electric potential." "Radiation" refers to "the emission of energy as electromagnetic waves or as moving subatomic particles, especially high-energy particles which cause ionization." "Resonance" refers to "increased amplitude that occurs when the frequency of a periodically applied force is equal or close to a natural frequency of the system on which it acts." "Resonance frequency," also know as "resonant frequency," refer to "the natural frequency where a medium vibrates at the highest amplitude." "Resonator" consists or comprises of "an electronic device having a combination of elements having mass and compliance whose acoustical reactances cancel at a given frequency." "Acoustic transducer" refers to "a device that converts acoustic energy to electrical or mechanical energy." "Bulk modulus" refers to "the ratio of the infinitesimal pressure increase to the resulting relative decrease of the volume of a substance." "Anisotropic" refers to "having a physical property that has a different value when measured in different directions, or varying in magnitude according to the direction of measurement." "Resistor" refers to "a device having a designed resistance to the passage of an electric current."

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

BRIEF DESCRIPTION OF THE DRAWINGS

FIG. 12A shows a perspective view of the AMM passive impedance matching device specifically for an AMM headphone showing the shunt compliance chambers with and inductive open vent tube according to one embodiment of the present disclosed technology.

FIG. 12B shows a schematic view of an equivalent single band double negative unit cell according to one embodiment of the disclosed technology.

FIG. 12C shows a schematic view of an equivalent dual band double negative unit cell according to one embodiment of the disclosed technology.

DETAILED DESCRIPTION OF EMBODIMENTS OF THE DISCLOSED TECHNOLOGY

Figure 1:
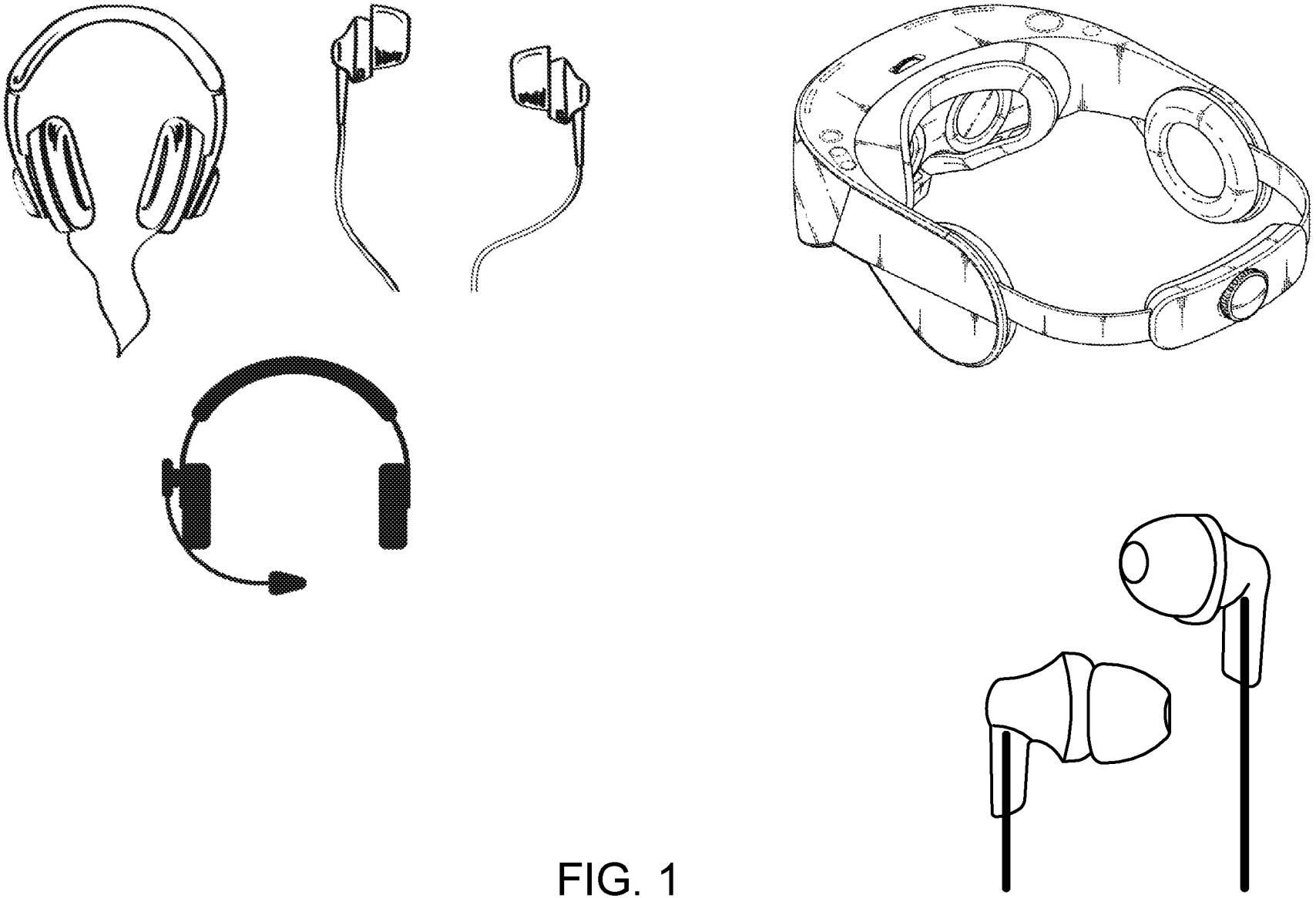
FIG. 1 shows a variety of headphone type devices including a headset, earbuds, a virtual reality (VR) headset, a headphone, and an in-ear monitor.
Figure 2:
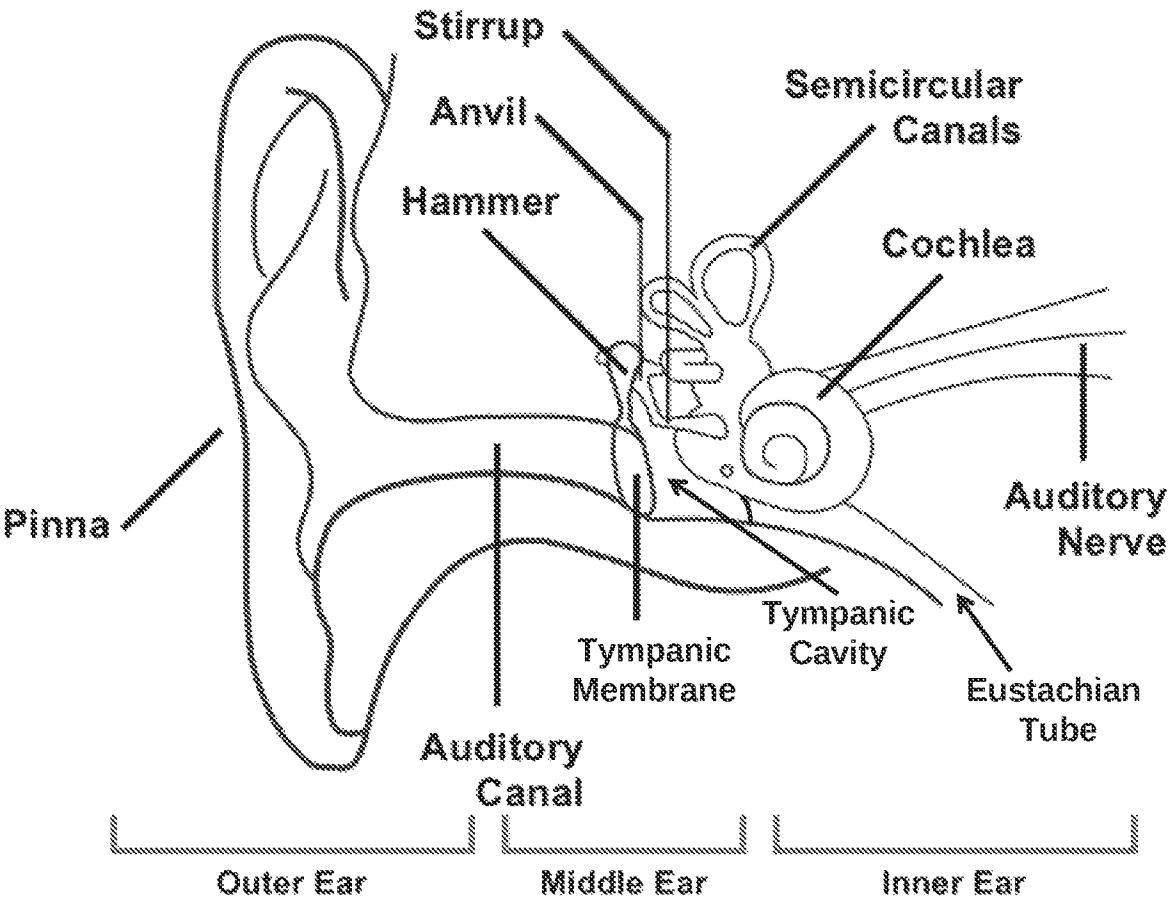
FIG. 2 (Prior Art)
FIG. 2 shows a schematic view of the anatomy of a human ear.

The main objective of this disclosure is to devise a method for management of acoustics and impedance matching of the headphone type devices with the complex acoustic impedance of the human ear to maximize the sound power radiation/transmission from the loudspeaker driver in the headphone and enhance its performance using acoustic metamaterial (AMM) principles.

The present disclosed technology provides an acoustic metamaterial passive impedance matching device for use in headphone type devices to match the complex radiation impedance of a human ear canal. The acoustic impedance device has shunt compliances, (e.g., volume resonators) and inductive elements of narrow slits/channels which connect them to the headphone/ear canal cavity together with a shunt inductance also connected to the main headphone cavity. The device may include a plurality of such shunt compliances stacked concentrically from the upper end to the lower end, and a plurality of side channels/slits extending annularly around a circumference and connecting the compliances/resonators to headphone cavity. The side channel defines a narrow slit of dimensions representing a predetermined acoustic inductance whereas a resonator volume enclosing a predetermined volume of air represents acoustic compliance. The side channel and the shunt resonator volume generate complex acoustic impedance that matches the acoustic impedance of the human ear.

Impedance indicates a capacity of a medium that impedes or restricts the flow of energy. The radiation impedance of a vibrating object is typically defined in the same manner as mechanical impedance, that is, as the ratio of force to velocity.

Laboratory ear simulators that simulate human ear are used for testing performance of most of the headphone type devices that radiate sound into human ear. However, these (e.g., headphone) devices are not impedance matched with the ear and as a result, some or most of the sound energy is reflected back from the ear canal due to impedance mismatch, thereby making them inefficient.

The load, i.e., the complex radiation impedance $Z_L$, that the surrounding medium places on the radiator (i.e., loudspeaker driver), in the headphone, is an important factor. The knowledge of $Z_L$ allows us to quantify: (1). Power radiated from a source to the environment, and (2). The resistive and reactive forces of the medium on the source.

The imaginary part of the radiation impedance (the reactance, $X_L$) can be thought of as governing the energy stored in the fluid that continually reacts with the vibrating/radiating surface and affects or impedes its motion. This stored energy does not travel away from the radiator. If efficient and or maximum generation/radiation of sound, that is sound radiation into ear from a headphone device, is desired, then impedance matching between the source (e. g., headphone driver) and the ear canal must be considered.

Sound radiation from a source depends on the type of environment or ambient medium it is radiating into, as the radiation impedance load imposed on the source is determined by the ambient medium. For sound waves propagating in a waveguide, a plane wave situation may be more appropriate. Ear canal, for example, can be modeled as a waveguide with certain impedance.

The resistive component is the only part involved in radiation of real sound energy. Thus, the radiated sound energy related to the real part of the radiation resistance is useful and represents the power output of the loudspeaker.

The sound power used up by the imaginary part, i.e, the radiation reactance, on the other hand, "is 'watt-less' power, involving energy which surges out from the source and then back towards the source, without ever being radiated as sound waves and that it involves "the mass or inertial property of the air that is involved." It is "the mass reaction of the medium to the vibrating sphere", the "additional apparent mass of the sphere", and "accession to inertia." It is "a term proportional to the surface particle acceleration, embodying the inertia force associated with the accession to inertia or entrained mass of fluid set into motion by the pulsating surface of the spherical source. "The fluid surrounding the source behaves like an effective mass".

The maximum power transfer theorem, states that a power source with source impedance $Z_s$ will transfer the maximum amount of power to a load impedance $Z_s$* (e.g., ambient load) which is the complex conjugate of the source impedance. The theorem includes the complex impedance (i.e., reactance), and states that maximum power transfer occurs when the load impedance is equal to the complex conjugate of the source impedance. If maximum power transfer between the loudspeaker driver in the headphone and the human ear is facilitated using the impedance matching device proposed in this invention disclosure, sound energy will propagate unimpeded into the ear canal.

Figure 5A:
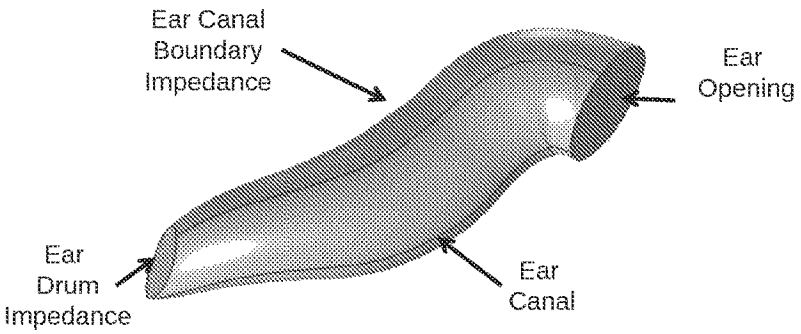
FIG. 5A shows a perspective view of a finite element (FE) model of an ear canal according to one embodiment of the present disclosed technology.
Figure 5B:
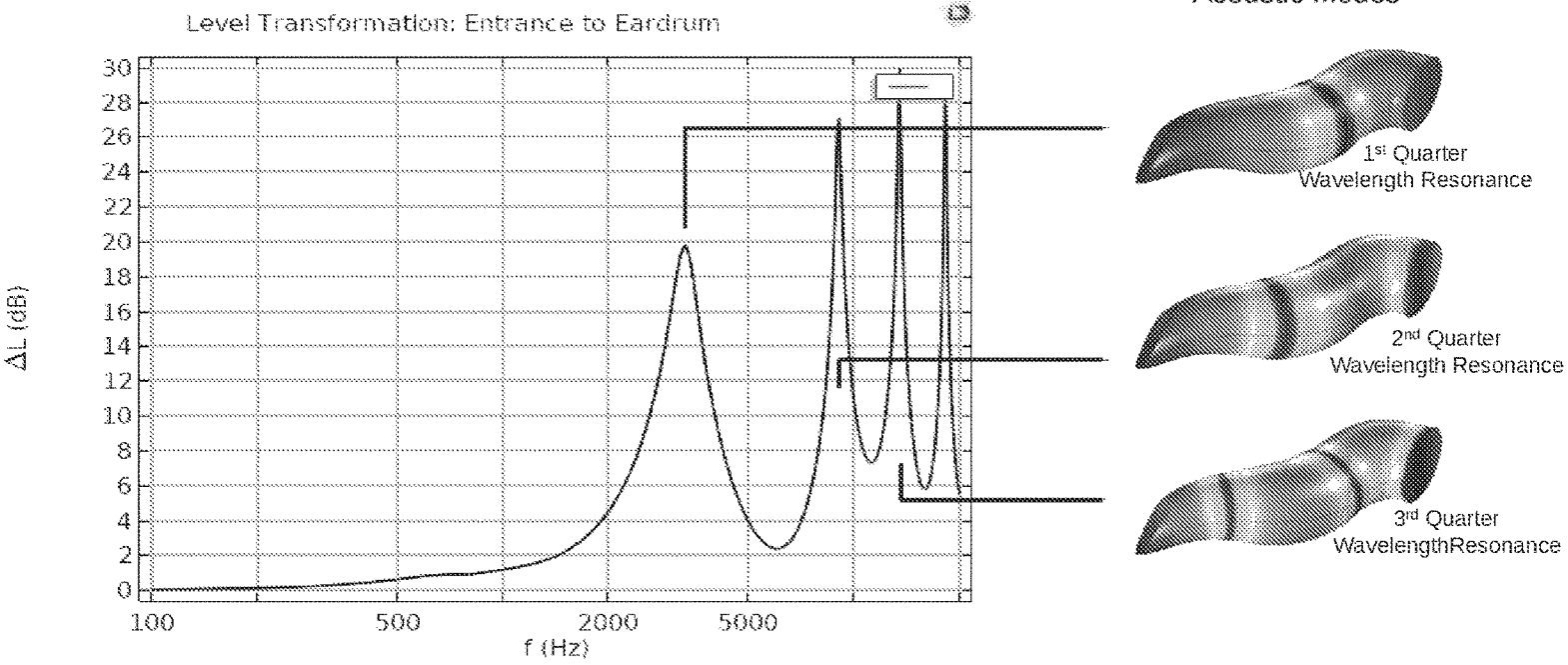
FIG. 5B shows a level transform curve, illustrating the pressure at the ear canal inlet relative to the pressure at the eardrum on the left and the quarter wavelength ear canal resonances on the right, according to one embodiment of the present disclosed technology

Referring now to FIG. 5A and FIG. 5B, FIG. 5A shows a perspective view of a finite element (FE) model of an ear canal according to one embodiment of the present disclosed technology. FIG. 5B shows a level transform curve, illustrating the pressure at the ear canal inlet relative to the pressure at the eardrum on the left and the quarter wavelength ear canal resonances on the right, according to one embodiment of the present disclosed technology. FIG. 6A shows a possible human ear model topology that relates structure to function of the middle-ear air space. FIG. 6B represents connections between the tympanic cavity and the mastoid air-cell system that are in addition to the aditus ad antrum. Specifically, each series connection between a mass, resistor, and compliance represents a "tube-like" connection from the tympanic cavity to a volume of air within the mastoid air-cell system. The model may include a total of n such connections. The FE model represents 2 possible tracts within the mastoid air-cell system that originate at the antrum and terminate with a volume of air; the FE model does not represent that each air-cell tract generally gets smaller as it moves away from the antrum. It has been observed that variations in human middle-ear air spaces might influence the impedance at the tympanic membrane: (1) below 1000 Hz the effect depends on the total volume of the middle-ear air space and systematically increases or decreases the total magnitude by a few dB at all low frequencies, and (2) above 1000 Hz, the effect is complicated, depends on the specific anatomy of a particular ear, and can introduce multiple maxima and minima as a fine structure in the impedance [Ref: Stepp and Voss, "Acoustics of the human middle-ear air space," 861-871, Journal of the Acoustical Society of America, 2005].

Figure 3A:
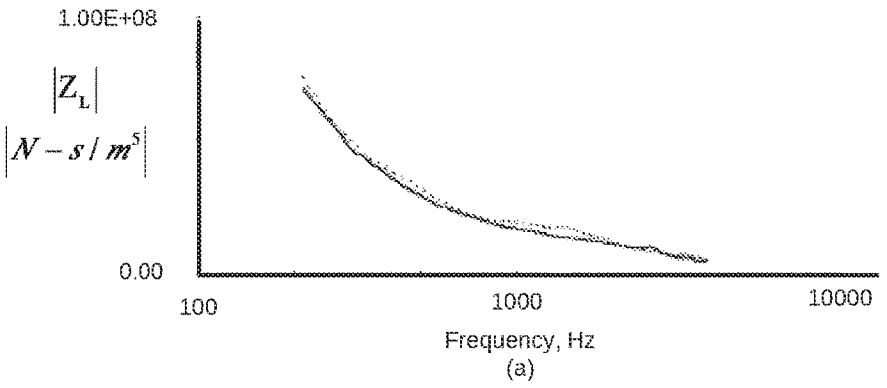
FIG. 3A shows the measured absolute impedance ($Z_L$) of the impedance of a human ear canal, according to one embodiment of the present disclosed technology.
Figure 3B:
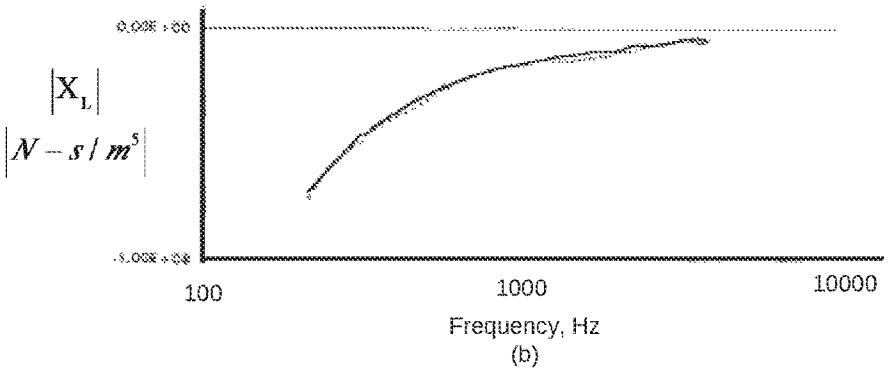
FIG. 3B shows the measured imaginary part ($X_L$) of the impedance of a human ear canal, according to one embodiment of the present disclosed technology.
Figure 3C:
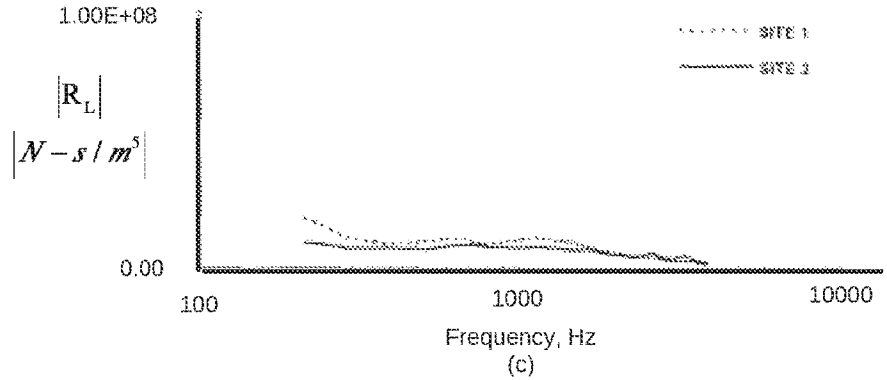
FIG. 3C shows the measured real part ($R_L$) of the impedance of a human ear canal, according to one embodiment of the present disclosed technology.
Figure 4:
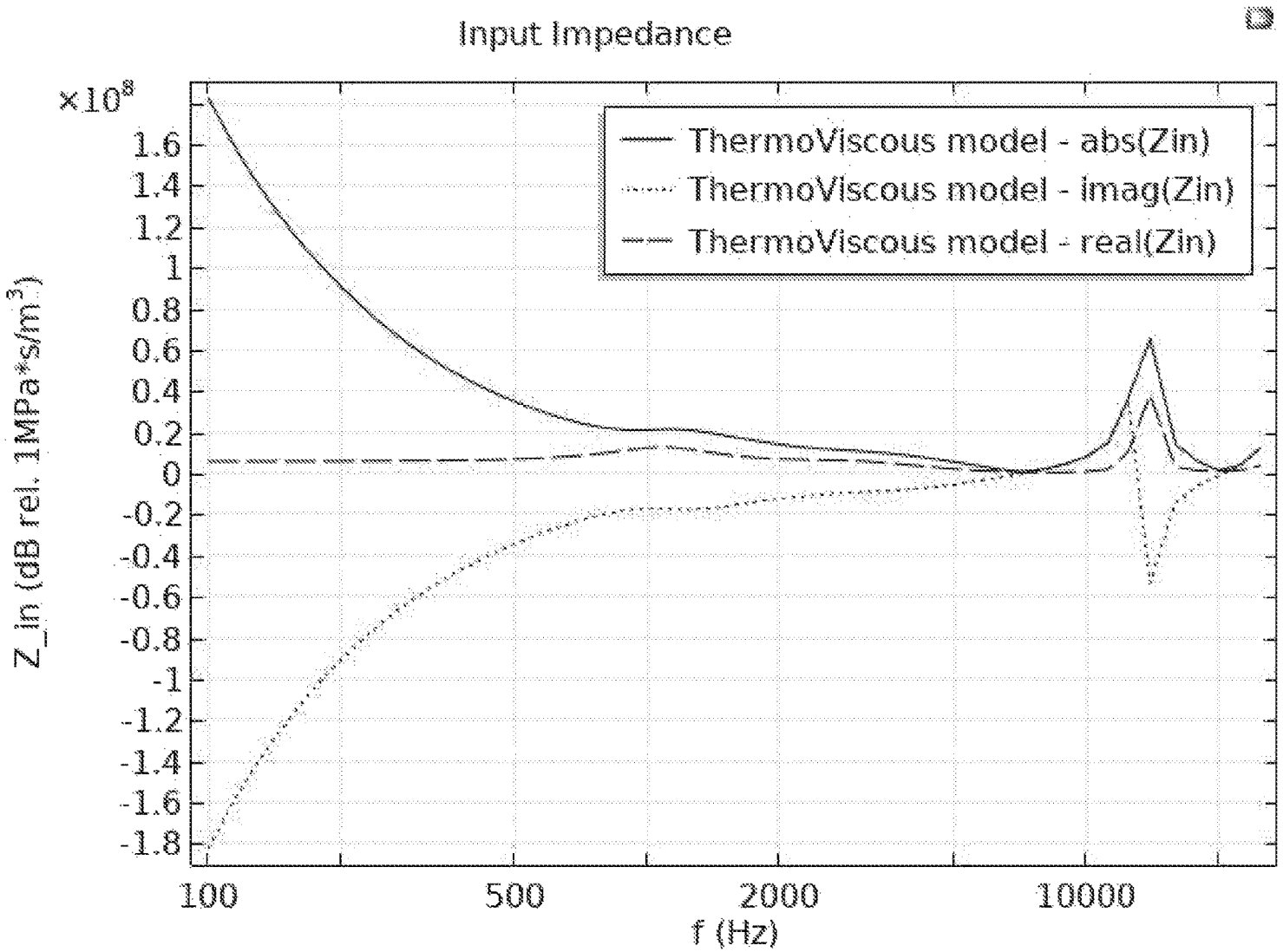
FIG. 4 shows a graph of calculated ear impedance illustrating acoustic impedance ($Z_L$) with the line associated with abs($Z_{in}$), imaginary impedance ($Z_L$) with line associated with imag($Z_{in}$), and real impedance ($R_L$) with the line associated with real($Z_{in}$), according to one embodiment of the present disclosed technology.
Figure 6:
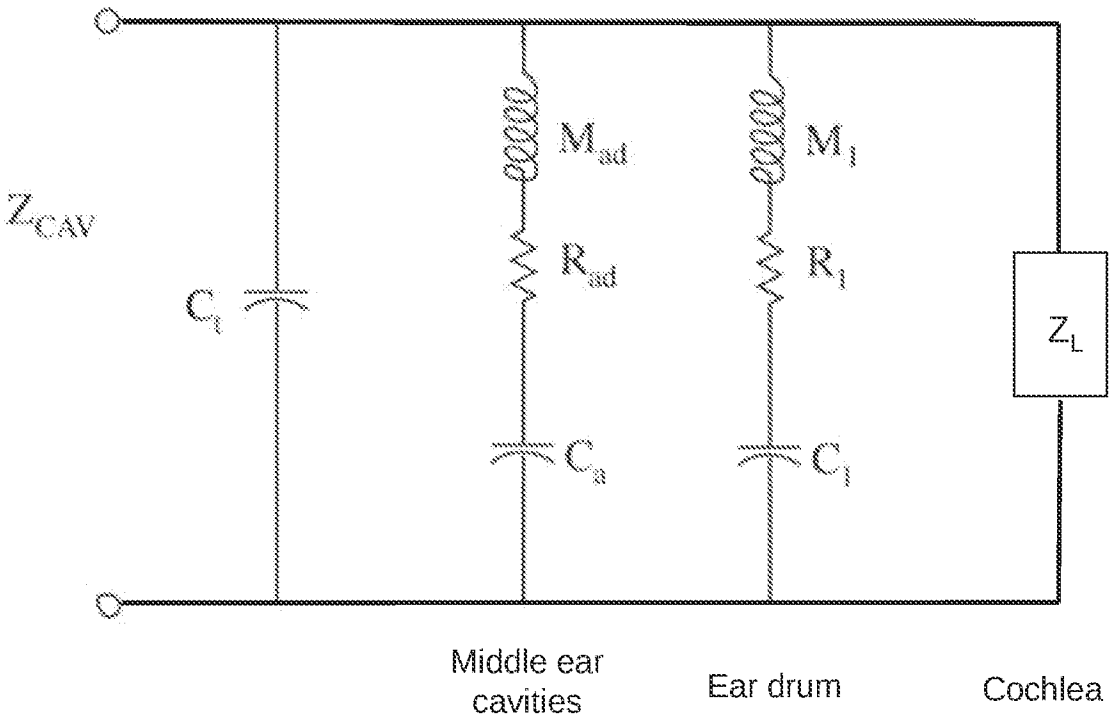
FIG. 6 shows a lumped-element model that represents the middle-ear cavity impedance ZCAV and ear drum according to one embodiment of the present disclosed technology.
Figure 7A:
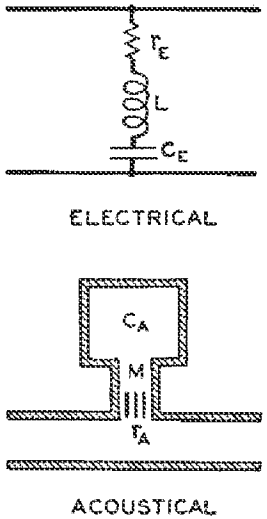
FIG. 7A shows an analogous lumped acoustic element and equivalent electrical circuit representing the middle-ear cavity impedance ZCAV and ear drum according to one embodiment of the present disclosed technology.
Figure 7B:
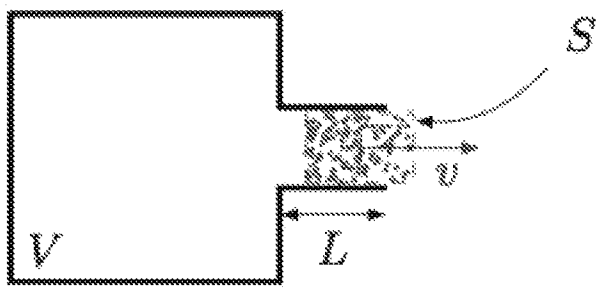
FIG. 7B shows a capacitive element and an acoustic capacitance according to one embodiment of the present disclosed technology.

Referring now to FIG. 3A, FIG. 3B, FIG. 3C, FIG. 4, and FIG. 6, simultaneously, FIG. 3A shows the measured absolute impedance ($Z_L$) of the impedance of a human ear canal according to one embodiment of the present disclosed technology. FIG. 3B shows the measured imaginary part ($X_L$) of the impedance of a human ear canal according to one embodiment of the present disclosed technology. FIG. 3C shows the measured real part ($R_L$) of the impedance of a human ear canal according to one embodiment of the present disclosed technology. FIG. 4 shows a graph of calculated ear impedance illustrating acoustic impedance ($Z_L$) with the line associated with abs($Z_{in}$), imaginary impedance ($Z_L$) with line associated with imag($Z_{in}$), and real impedance ($R_L$) with the line associated with real($Z_{in}$), according to one embodiment of the present disclosed technology. FIG. 6 shows a lumped-element model that represents the middle-ear cavity impedance $Z_{CAV}$ and ear drum according to one embodiment of the present disclosed technology. FIG. 6 defines the average middle ear impedance, $Z_{CAV}$. $C_t$ represents the compliance of the tympanic cavity, with $C_t=V_t/(\rho c^2)$, $M_{ad}$ and $R_{ad}$ represent the "tube-like" aditus ad antrum that connects the tympanic cavity and the mastoid cavity. $C_a$ represents the compliance of the antrum and other air cells, with $Ca=V_a/(\rho c^2)$, where $V_a$ is the total volume of the antrum and other mastoid air cells. The impedance $Z_{CAV}$ is plotted in the graph of FIG. 4. The imaginary part of this impedance is the reactance or inductance of the middle ear. This reactance of air is moving back and forth as if it were incompressible. The middle-ear air space does affect the impedance at the tympanic membrane. Above 1000 Hz, the major results include: (1) the introduction of multiple maxima and minima in the impedance at the tympanic membrane when $Z_{CAV}$ comes from the impedance measured on ears with unaltered mastoid cavities, versus the models or the altered mastoid cavity of bone and (2) variations of more than 10 dB in magnitude and 0.1 cycles in angle from the impedances predicted by either model. The introduction of multiple maxima and minima is consistent with the impedance measurements.

The effectively radiated power W by moving piston is:

$$W=Q^2\times\mathrm{Real}[Z_R]$$

where, Q: volume flow (product of velocity and piston area) and Re[$Z_R$]: real (active) part of radiation impedance.

As aforementioned, the measured absolute impedance $Z_L$, imaginary part ($X_L$) and real part ($R_L$) of the impedance of human ear canal are shown in FIG. 3A, FIG. 3B, and FIG. 3C, respectively. Similarly, calculated impedance curves using analytical models are shown in the graph of FIG. 4. The imaginary part, which is the reactive part of the radiation impedance, is more dominant below 1000 Hz, whereas the resistive part is quite robust and rises at lower frequencies, as observed in FIGS. 3A-3C and FIG. 4.

FIG. 4 also shows real (resistive) and imaginary (reactance) parts of the ear impedance. The reactive part, which is inductive, implies that particle velocity lags acoustic pressure in the low frequency region (<1000 Hz). The reactive impedance, $j\omega X_L$, below 1000 Hz, of the ear canal is like that of an inductive element. The reactance shows the general trend of being stiffness-controlled at low frequencies and mass-controlled at high frequencies, with multiple resonances between 1 and 4 kHz. The real part (i.e., the resistive impedance) also increases steadily below 1000 Hz. Resistance in the middle ear was found to contribute significantly to the total resistance.

In the low-frequency limit, an open tube is called an acoustic inductance or an inertance and it has a direct analogy to the inductance in electrical circuit analysis or the mass in mechanical system analysis. The acoustic impedance of an open tube of length, L, and area A, is then given by:

$$Z(\omega)=\{P(\omega)\}/\{U(\omega)\}=j\omega(\rho_m L/A),$$

where, $U(\omega)=AV(\omega)$ is the acoustic volume velocity of the air mass and $P(\omega)$ is applied sinusoidal pressure.

Using acoustic metamaterials, acoustic wave propagation can be controlled by appropriate design of the refractive index distribution of the medium. In addition to the refractive index, the acoustic impedance also affects the sound propagation characteristics. For loudspeaker driver in the headphone, the radiation impedance allows the phase relationship between the surface pressure and the object velocity to be quantified. At lower frequencies, these two quantities are generally not in phase, with the velocity lagging behind the surface pressure by 90°.

It is possible to obtain some extraordinary acoustic fluid parameters ($\rho_0$ and $B_0$), i.e., density and bulk modulus, by modifying the structural parameters of acoustic metamaterials, that cannot be realized easily using natural materials. These parameters include negative mass density and negative bulk modulus values, anisotropic mass density tensors, and anisotropic elasticity tensors.

Figure 9A:
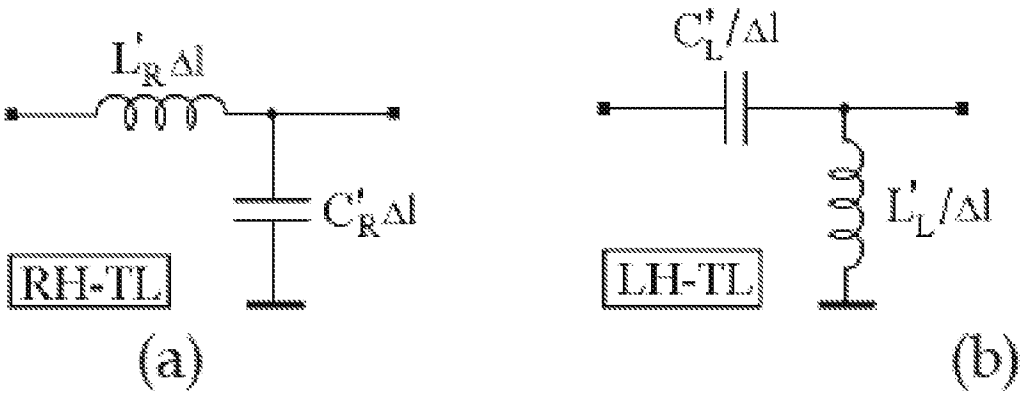
FIG. 9A shows equivalent circuits with distributed elements for a cell of (a) Right-Handed (RH)-TL and (b) Left-Handed (LH)-TL according to one embodiment of the present disclosed technology.
Figure 9B:
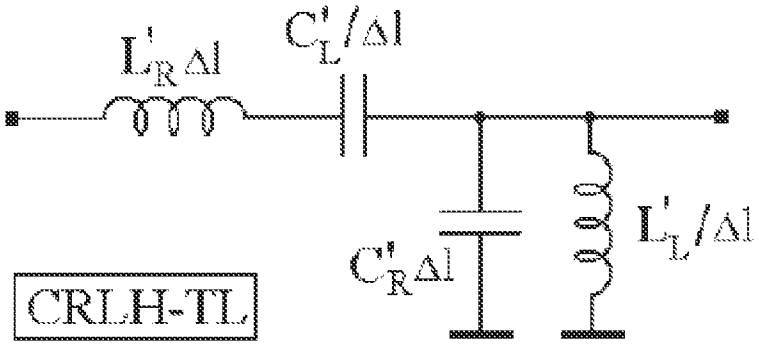
FIG. 9B shows the distributed equivalent circuit for a cell of CRLH-TL according to one embodiment of the present disclosed technology.

Referring now to FIGS. 9A and 9B, simultaneously, FIG. 9A shows equivalent circuits with distributed elements for a cell of (a) Right-Handed (RH)-TL and (b) Left-Handed (LH)-TL according to one embodiment of the present disclosed technology. FIG. 9B shows the distributed equivalent circuit for a cell of CRLH-TL according to one embodiment of the present disclosed technology. Recently, metamaterials with simultaneously negative permittivity (ε) and permeability (μ), more commonly referred to as left-handed (LH) materials, have received substantial attention. In the realm of electromagnetics, there is a common distinction between two types of metamaterials: arrays of resonant inclusions, such as the split-ring resonator and transmission line (TL) based metamaterials. While the materials of the first type are inherently narrow band and lossy due to their resonant nature, the latter can exhibit the desired meta-properties, such as negative refraction, over a much larger bandwidth and with lower losses since they do not explicitly rely on resonance.

Most of the acoustic metamaterials reported to date belong to the category of resonant inclusions, whereas very few works on the acoustic counterparts of TL-based metamaterials have been reported. This requires the realization of acoustic or mechanical elements, which implement shunt "inductances" (i.e., acoustic masses) and series "capacitances" (i.e., acoustic compliances).

Left-handed materials (LHMs), which in a wider sense, are also referred to as negative index materials (NIMs), simultaneously have negative permittivity, E, negative permeability, μ, and negative refractive index, n, over a common frequency band. The term "left-handed material" (LHM) was first introduced by Veselago in 1968, who predicted there exists such a medium in which the electric field, E, the magnetic field, H, and the wave vector, k, form a left-handed orthogonal set. However, left-handed materials do not exist in nature.

Transmission line approach is based on the dual of a conventional transmission line. Backward wave transmission line (TL) can form a non-resonant LHM. Series capacitance ($C_L$) and shunt inductance ($L_L$) combination supports a fundamental backward wave. Perfect LH TL is not resonant dependent but has a low loss and broadband performance.

An acoustic metamaterial that does not cause reflections at boundaries in all frequency regions while exhibiting positive and negative refractive index properties will be preferential.

In most of the cases, an anti-reflection property was only achieved at a specific refractive index range or angle of incidence, and there have been no reports to date of an anti-reflection property being achieved for all refractive indices, including positive and negative indices, and regardless of the angle of incidence. In transmission line metamaterials, the impedance of the metamaterial can be matched with that of the air when the balanced condition is satisfied. This condition can be achieved by ensuring that the product of the shunt inductance and the capacitance has the same value as the product of the series inductance and the capacitance (e.g., $L'_{RH}C'_{LH}=L'_{LH}C'_{RH}$). The lumped series capacitance is indexed, $C_{LH}$, and the shunt inductance, $L_{LH}$, LH stands for left-handed. In such a balanced metamaterial, reflections can be strongly suppressed and the transmission can be maximized over the entire refractive index range.

In equivalent RH-TL and LH-TL circuits, as shown in FIG. 9A, $L'_R$, $C'_R$ and $L'_L$, $C'_L$ are the distributed inductance and capacitance for RH-TL and LH-TL respectively. For a balanced CRLH-TL circuit, as shown in FIG. 9B, the impedance matching conditions over a large frequency domain can be easily fulfilled.

$$Z_{c,CRLH\text{-}TL}=Z_{c,RH\text{-}TL}=Z_{c,LH\text{-}TL}$$

The equivalent circuit of CRLH-TL is a combination of the equivalent circuits for RH-TL and LH-TL. FIG. 9B shows the equivalent circuit for CRLH TL where, similar to RH-TL and LH-TL, Δl must be small enough compared to the wavelength. From the maximum power transfer theorem, thus, the added matching conjugate impedance $Z^*_L$ (i.e., $R_L+X_L$) balances the existing $Z_L$ (i.e., $R_L-X_L$).

The balanced (CRLH) metamaterial approach can now be seen as an implementation of the maximum power transfer theorem. It also explains how the maximum power transfer really works and can be achieved in nature.

Circuit-theory concepts have been used to conceptualize and design an acoustic non-resonant TL-based metamaterial. Series compliances were implemented using membranes whereas the shunt acoustic masses were realized with transversally connected open channels. Such a metamaterial exhibits a negative refractive index over almost one octave (0.6-1 kHz), which is larger than what can be achieved with locally resonant acoustic metamaterials. However, one-octave coverage is very inadequate for audio applications and must be extended over at least 3 or more octaves.

In the present disclosed technology, an acoustic metamaterial impedance matching device for headphone type devices inserted in an ear canal, using open-tube inductive and shunt compliance architecture, that is impedance matched for an ear canal for all refractive indices including negative indices, is devised and disclosed. This arrangement is highly distinctive and different from previous attempts and is based on the fact that the loudspeaker driver radiation impedance itself, as described earlier, has resistive, inductive and capacitive elements. It is important to note that the resistive, inductive and capacitive impedance of a loudspeaker driver in the headphone needs to be matched with a similar but conjugate environment. The characteristic impedance of air is specific acoustic impedance (z) (characteristic impedance, wave impedance) is the opposition of a medium to wave propagation, and it depends on the medium properties and the type of wave propagating through the medium. The specific impedance of a medium opposing the propagation of a plane sound wave is equal to: $Z=\sqrt{B_0\rho_0}=\rho_0 c$, where $B_0$ is the bulk modulus of the medium in N/m2, $\rho_0$ is the density of the medium in kg/m3 and c is speed of sound in m/s. Thus, Z depends on both bulk modulus and density of the medium. The pressure in a periodic sound wave can be related to the displacement:

$$\Delta P_{max}=B_0 k s^2_{max},$$

where, $B_0$ is the bulk modulus of the medium, k (=ω/c) is wavenumber, and $s_{max}$ is the displacement of sound wave. The average intensity (the rate at which the energy being transported by the wave transfers through a unit area) over one period of the oscillation is:

$$(I)_{avg}=\frac{1}{2}\sqrt{B_0\rho_0}\,\omega^2 s^2_{max}$$

where, ω is the angular frequency. Thus, power or intensity carried by sound wave is proportional to the square root of both bulk modulus and density of air. The inductor and capacitor are analogous to open end and closed end pipes, respectively. By combining acoustic inductors and capacitors in a shunt compliance acoustic element, a device with negative refractive index can be realized. The acoustic mass is equivalent to the mass of the air in the enclosed element divided by the square of the cross-sectional area of the element. Also, since some small volume of the medium on either end of the tube is also entrained with the media inside the tube, the "acoustic" length is usually somewhat larger than the physical length of the tube. For a single open end, the difference between the physical length and the acoustic length is Δl≈0.8a, also called the end correction. A structure that may be well approximated by an acoustic compliance is an enclosed volume of air with linear dimensions (<0.1λ). The variations in sound pressure within an enclosed air volume generally occur about the steady-state atmospheric pressure, the ground potential in acoustics.

The basic constituent parameters that determine the propagation characteristics of acoustic waves in a medium are the density of the medium $\rho_0$ and its bulk modulus $B_0$. The velocity of an acoustic wave in the medium c and the refractive index relative to air n are given by:

$$c=\sqrt{\frac{B_0}{\rho_0}};\ n=\sqrt{\frac{\rho_r}{B_r}}$$

where, $B_r=B/B_0$ and $\rho_r=\rho/\rho_0$ are the relative values of the bulk modulus and the mass density of the medium, respectively, with respect to values in air, which are $B_0=1.42\times10^5$ Pa and $\rho_0=1.22$ kg/m$^3$.

When open tubes (OTs) are installed periodically as lumped elements in a one-dimensional acoustic waveguide, the pressure amplitude in the waveguide is affected by the dynamic motion of the air column that exists in the OT, and the value of the bulk modulus thus changes. In this case, the bulk modulus of the medium B is given by:

$$B=B_0/[1-(\omega^2_{OT}/\omega^2)],$$

where the transition frequency of the bulk modulus is given by:

$$\omega_{OT}=c\sqrt{\frac{S}{l'dA}}$$

If only OTs have been installed, the mass density of the metamaterial $\rho$ is equal to that of air $\rho_0$. Here, c, S, l', d, and A are the speed of sound in air, the cross-sectional area of the OT, the effective length of the OT, the unit cell length, and the cross-sectional area of the waveguide, respectively.

Figure 8:
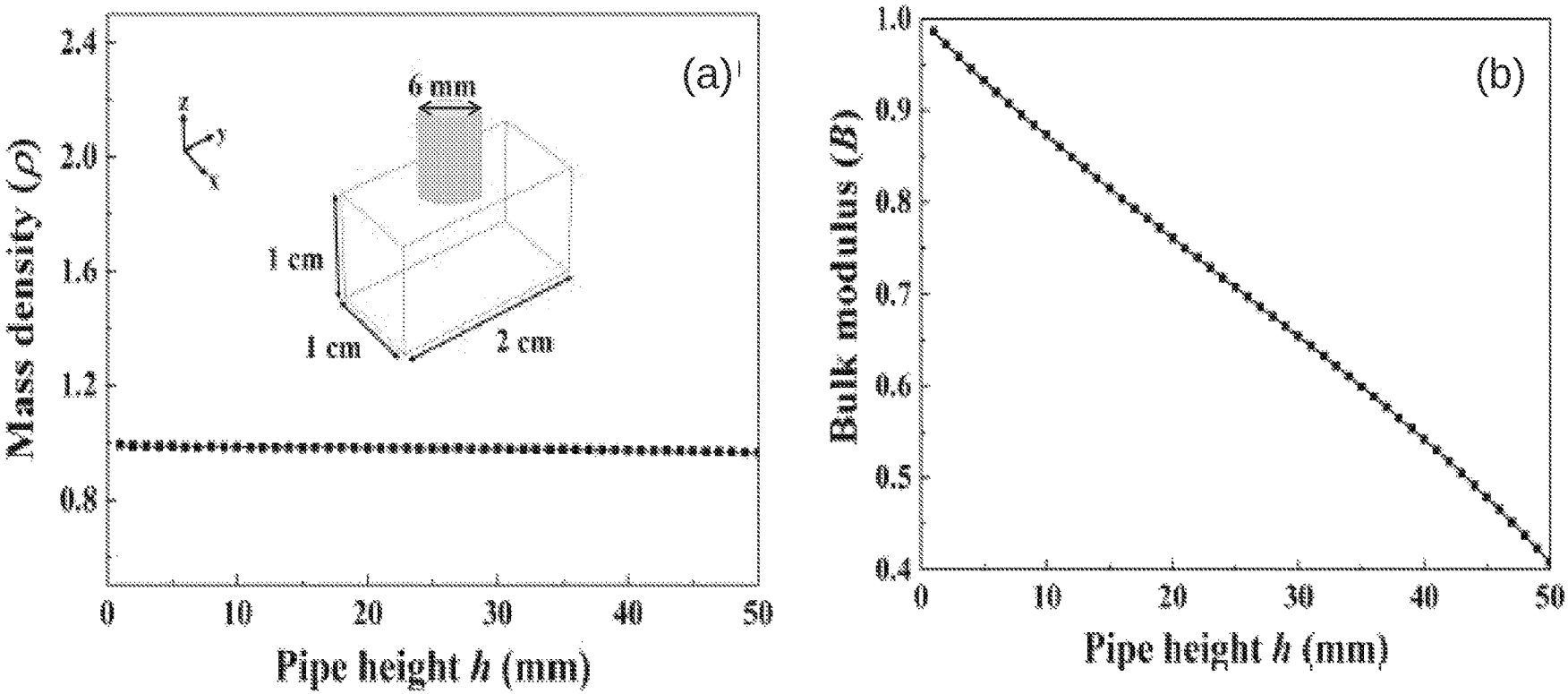
FIG. 8 shows an inductive unit cell illustrating the effect on mass density (a) and the bulk modulus (b) with respect to the geometrical parameters of the unit cell with the side pipe [inset in (a)] according to one embodiment of the present disclosed technology.

Referring now to FIG. 8, FIG. 8 shows an inductive unit cell illustrating the effect on mass density (a) and the bulk modulus (b) with respect to the geometrical parameters of the unit cell with the side pipe [inset in (a)] according to one embodiment of the present disclosed technology. The two types of unit cells, e.g., slits/channels (e.g., tubes) with shunt compliance can be combined to obtain a new complex unit cell, as shown in graph (a) of FIG. 8, which can be used to modify the mass density and bulk modulus, needed to modify resistance and reactance, in the near-field of loudspeaker driver of the headphone simultaneously. Such a shunt compliance device is also popularly known as a Helmholtz resonator. Ear canal impedance is simulated by appropriate selection of the design parameters (e.g., S, V, L) of the shunt compliance and the connecting inductive tube/channel. A side tube in a unit cell could be used to modulate the bulk modulus of the medium by varying the side tube's height. The change in pressure in the main tube is $p=-B_0(\Delta V-\Delta V_h)/V$, and the change in pressure in the side tube is $p_h=-B_0DV_h=\Delta V_h/V_h$. Here, V and $V_h$ represent the volumes of the main tube and the side tube, respectively, while $\Delta V$ and $\Delta V_h$ are the small changes in the main tube and side tube volumes, respectively. The effective bulk modulus is only dependent on the observable volume change $\Delta V$, and thus, the formula becomes $p=-B_{eff}\Delta V/V$. Because $p=p_h$, the effective bulk modulus is given by $B_{eff}=B_0/(1+V_h/V)$, which means that as the height of the side tube increases, the effective bulk modulus decreases.

Acoustic parameters such as negative mass density and negative bulk modulus that cannot exist in natural materials can be realized by using metamaterials such as membranes, Helmholtz resonators or side-branch resonators. The negative bulk modulus occurs in a periodic row of Helmholtz resonators. It happens at the resonances of a resonator. A double negative metamaterial medium allows the wave to propagate throughout it since the wave-vector is a purely positive real number. Since the index number of this material is negative, the refractive number should also be negative accordingly. Therefore, the double negative metamaterials can be used for sound manipulation applications. It has been theoretically and experimentally proven that the multiband double negativity originates from the overlap between the dipolar and mono-polar modes.

Referring now to FIGS. 12B and 12C, simultaneously, FIG. 12B shows a schematic view of an equivalent single band double negative unit cell according to one embodiment of the disclosed technology. FIG. 12C shows a schematic view of an equivalent dual band double negative unit cell according to one embodiment of the disclosed technology. A multi-frequency band double-negative ($-\rho_0$, $-B_0$ AMM design that is based on Helmholtz-resonator (HR) pairs whose double negativity ($-\rho_0$, $-B_0$ originates from the coupling between the adjacent HRs within a unit cell, as shown in FIG. 12B. This multiband double negativity is achieved by the multiple overlapping dipolar and mono-polar modes, wherein the unit cell is tuned by variation of the separation and the resonant frequency of the coupled HRs. An array of hybrid Helmholtz resonators, which form sound transmission band gap where the both the effective density and bulk modulus become negative values, is used in this invention.

The usable frequency bandwidth of single banded metamaterials can be increased by utilizing multi-frequency band, double-negative ($-\rho_0$, $-B_0$ metamaterials. In this invention disclosure, a multiband double-negative ($-\rho_0$, $-B_0$ AMM design that is based on Helmholtz-resonator (HR) pairs whose double negativity comes from the coupling between the adjacent HRs within a unit cell is used. Both single and dual band double AMM shunt compliance designs of FIG. 12B and FIG. 12C, respectively, may be used with AMM impedance matching device of the present disclosed technology.

Figure 10:
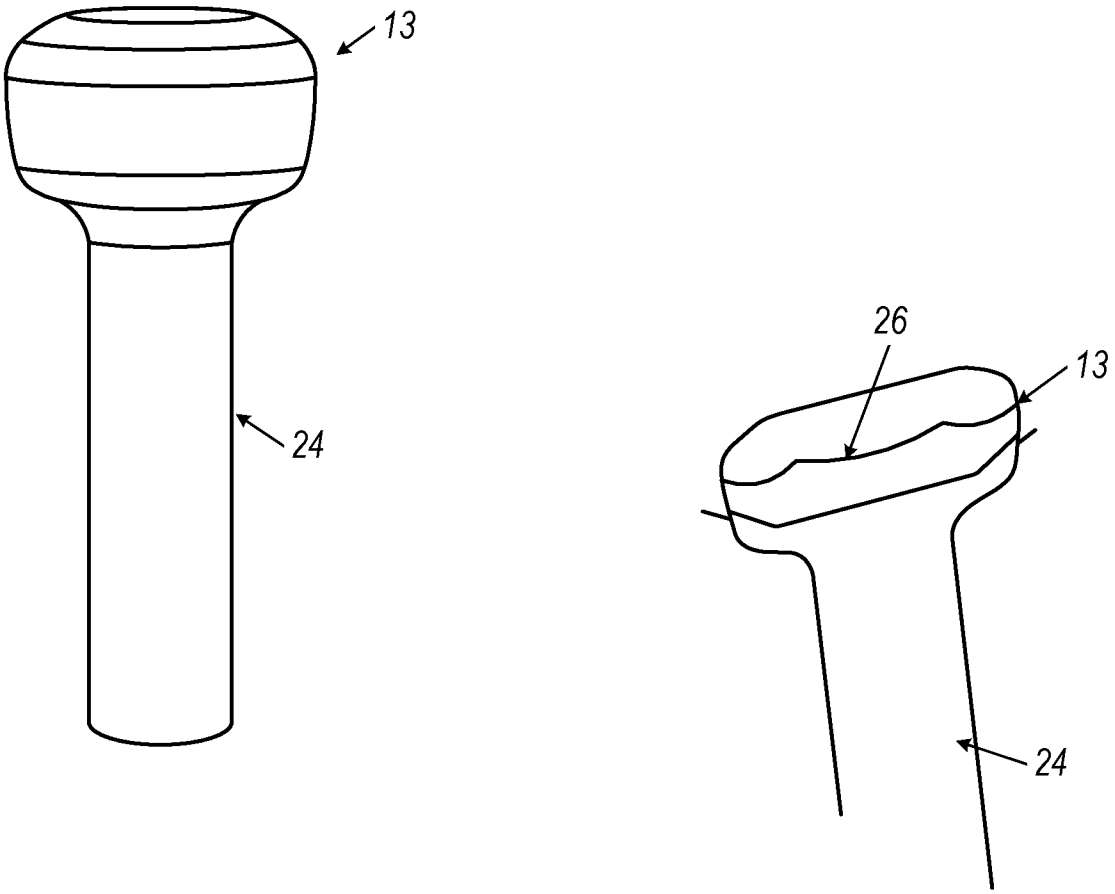
FIG. 10 shows a schematic view of an ear bud coupled with an ear canal without the AMM passive impedance matching device, illustrating the loudspeaker driver and the ear canal with respect to sound waves coming from the loudspeaker, according to one embodiment of the present disclosed technology.
Figure 11:
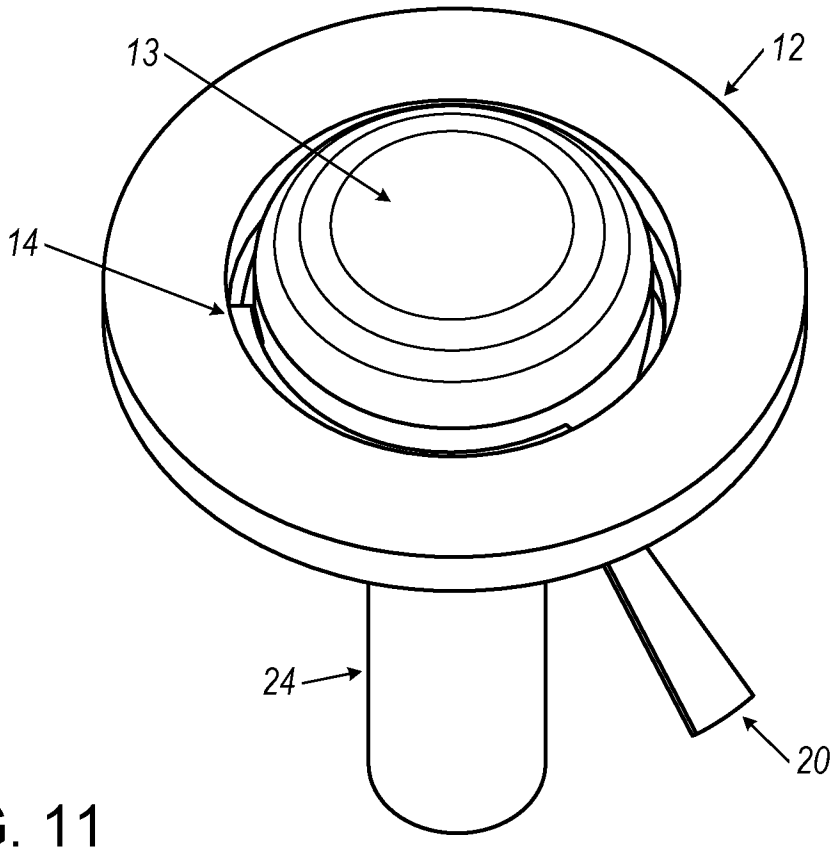
FIG. 11 shows a perspective view of the AMM ear bud passive impedance matching device mounted onto an ear bud coupled with the ear canal, illustrating the position of the shunt compliance chambers and inductive open vent tube of the AMM passive impedance matching device with respect to the ear bud according to one embodiment of the present disclosed technology.
Figure 13:
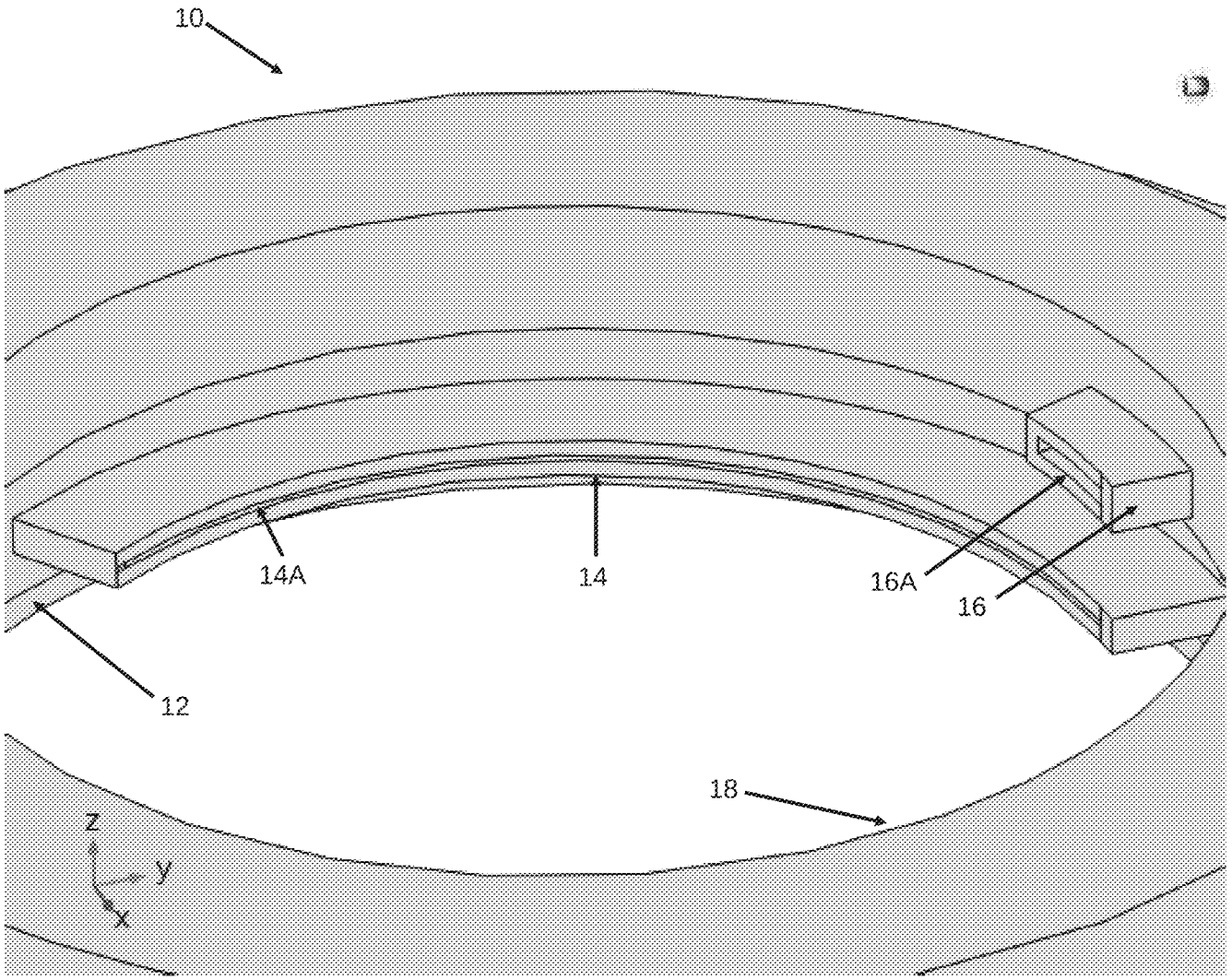
FIG. 13 shows a top perspective close-up view of an AMM passive impedance matching device compatible with a headphone including ear cups, illustrating the shunt compliance chambers and the inductive channels according to one embodiment of the present disclosed technology.
Figure 14:
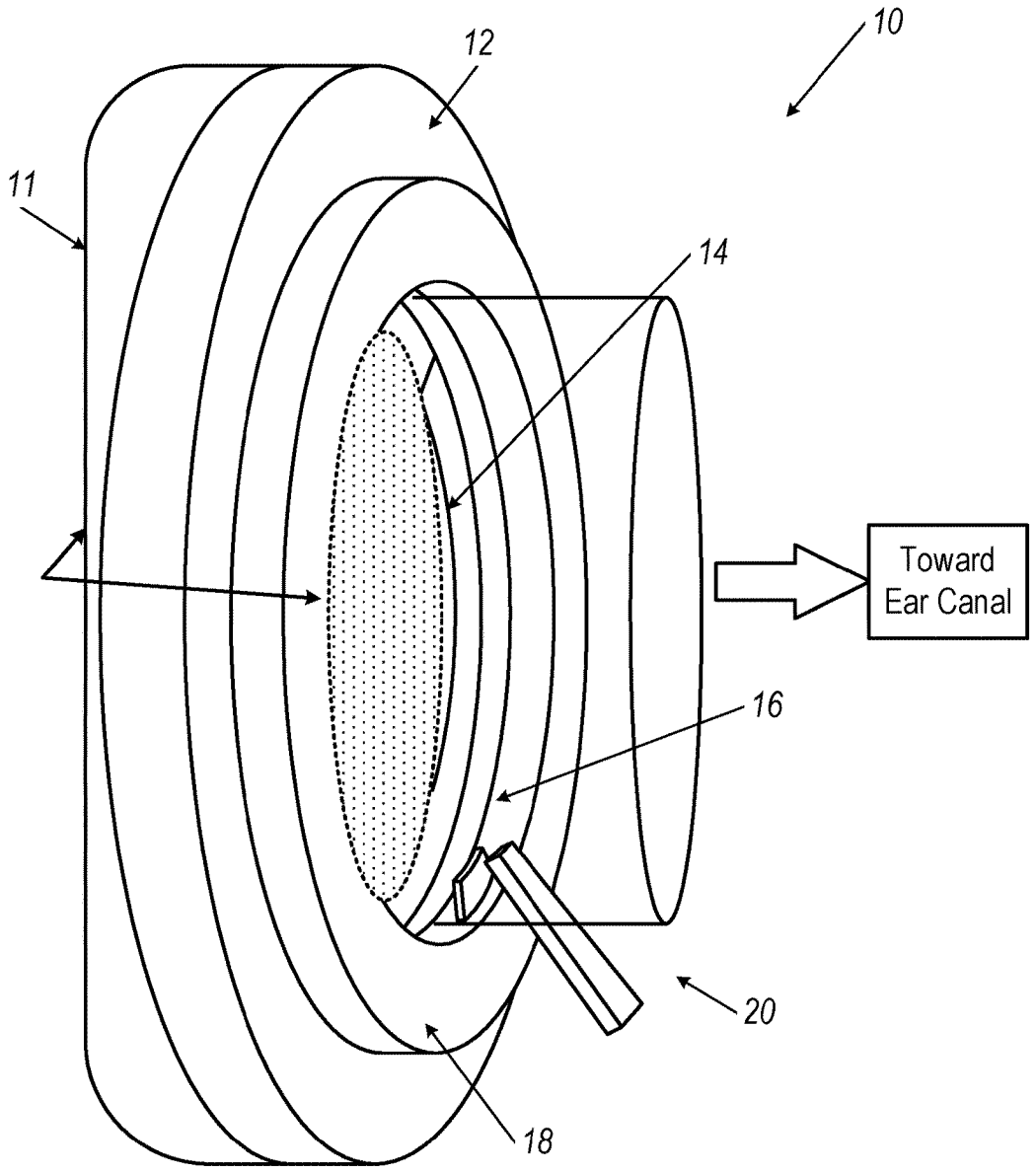
FIG. 14 shows a perspective view of the AMM passive impedance matching device assembly placed within a headphone cavity, illustrating the shunt compliant chambers, the inductive channels, and the inductive open vent tubes of the AMM passive impedance matching device as well as the configuration of the AMM passive impedance matching device with respect to an earphone cavity of a headphone according to another embodiment of the present disclosed technology.

Referring now to FIG. 10, FIG. 11, FIG. 12A, FIG. 13, and FIG. 14, simultaneously, FIG. 10 shows a schematic view of an ear bud coupled with an ear canal without the AMM passive impedance matching device, illustrating the loudspeaker driver and the ear canal with respect to sound waves coming from the loudspeaker, according to one embodiment of the present disclosed technology. FIG. 11 shows a perspective view of the AMM passive impedance matching device mounted onto an ear bud, illustrating the inductive compliances of the AMM passive impedance matching device as well as the configuration of the AMM passive impedance matching device with respect to the ear bud according to one embodiment of the present disclosed technology. FIG. 12A shows a perspective view of the AMM passive impedance matching device specifically for an AMM headphone showing the shunt compliance with and inductive vent according to another embodiment of the present disclosed technology. FIG. 13 shows a top perspective view of the AMM passive impedance matching device compatible with a headphone including ear cups, illustrating the shunt compliance with the inductive vent according to another embodiment of the present disclosed technology. FIG. 14 shows a perspective view of the AMM passive impedance matching device assembly placed within a headphone cavity, illustrating the shunt compliant chambers, the inductive channels, and the inductive open vent tubes of the AMM passive impedance matching device as well as the configuration of the AMM passive impedance matching device with respect to an earphone cavity of a headphone according to one embodiment of the present disclosed technology. In embodiments, the AMM passive impedance matching device 10 includes a pair of shunt compliance chambers 12, 18 and a pair of side connecting inductive channels 14, 16. The shut compliance chambers 12, 18 may comprise a plurality of volumes. The dimensions of the slits/channels depend on the shunt acoustic compliance required. Similarly, inductive reactance of the ear canal determines the dimensions and number of inductive channels 14, 16.

Due to the significant friction area inside the narrow slits/channels/necks of the Helmholtz resonators, as shown in FIG. 12A and FIG. 13, the dissipated energy via the thermal viscosity will be very much increased. Both the resonance frequency of the Helmholtz resonator and the thermal viscosity can be tuned flexibly by varying the slit dimensions and the cavity depth.

Knowing the complex impedance, $Z_L$, of the ear canal 24 into which the loudspeaker driver 26 is radiating, the effective parameters of the required unit cells can be calculated using the well-developed retrieval method disclosed in "Method for retrieving effective properties of locally resonant acoustic metamaterials." Phys. Rev. B, 76(14):144302, 2007, authored by V. Fokin, M. Ambati, C. Sun, and X. Zhang, or they can be evaluated using finite element methods. The effective refractive index n and impedance Z are obtained from the reflection and transmission coefficients of a plane wave that is normally incident on the metamaterial. The effective mass density $\rho_{eff}$ and bulk modulus $B_{eff}$ are then calculated based on n and Z. This means that a homogeneous fluid material that presents the same amplitude and phase of the reflection and transmission coefficients effectively replaces the metamaterial.

In some embodiments, AMM passive impedance matching device 10 includes a plurality of inductive channels 14, 16 are spaced around the circumference 21 connecting the shunt compliance chambers 12, 18 to the main cavity. In other embodiments, the plurality of inductive channels 14, 16 and the plurality of shunt compliance chambers 12, 18 alternate in arrangement. The plurality of inductive channels 14, 16 each include open ends 14A, 16A to provide an inductive reactance. The plurality of shunt compliances chambers 12, 18 each include a different volume with respect to one another.

The number of inductive channels 14, 16 and the number/quantity of shunt compliance chambers 12, 18 are functions of the impedance of the ear canal 24. Indeed, the quantity of the inductive channels 14, 16 and the pattern and the number of the shunt compliance chambers 12, 18 are dependent on the impedance of the ear canal 24. Further, the dimension of the inductive channels 14, 16 is a function of the reactance of the ear canal 24. Indeed, the dimensions of the inductive channels 14, 16 and shunt compliance chambers 12, 18 are dependent on the reactive impedance of the ear canal 24.

The AMM passive impedance matching device 10 is based on resistive and inductive TL elements. The inductive elements are implemented using an open vent tube 20, which is open at both ends. The open vent tube 20 has been traditionally used for controlling the pressure increase due to occlusion with the ear bud 13. Although venting has been found to typically affect frequencies below 1000 Hz, vent/leakage tube in this patent has been used as a design parameter in association with the shunt compliance chambers to significantly influence broadband acoustic performance, i.e., between 10-20000 Hz, of a headphone device. Since both shunt compliant chambers and the ear canal acting as a waveguide, are capacitive in nature and tend to filter out low frequencies, vent/leakage tube can be used along with them as an inductive element to control overall broadband performance.

In embodiments, the plurality of side channels 14 further comprises a second set of side channels 16 including closed ends to provide a capacitive reactance in addition to the inductive reactance provided by the first set of side channels 14 with open ends.

In embodiments of the disclosed technology, the AMM passive impedance matching device 10 allows less volume from a speaker for a same decibel or perceived volume into a human ear. The device 10 is a shunt device that is torus-, or ring-shaped. The device 10 is capable of being place around the neck portion of an ear bud 13, as shown in FIG. 11, or capable of being placed/mounted/installed within foam cups 11, i.e., the earphones, of a headphone unit, as shown in FIG. 14. and/or in front of a speaker/direction which the sound waves emanate from the speaker towards the ear. That is, the AMM passive impedance device 10 can be placed within foam cups and/or between output of a speaker/speaker itself and an ear canal. In this manner, the device 10 amplifies frequencies passively of the sound waves entering the ear canal. This device 10 fits into an ear canal. An interior portal of the shunt device 10 has a larger diameter than the ear bud so the shunt device 10 can fit around, albeit, snugly, in embodiments, on the ear bud 13 so that vibrations of the ear bud extend as compressed air waves (however minute) into the interior portals of the shunt device 10. The impedance matching of the shunt device 10 causes various designated frequencies (such as bass frequencies) to be amplified allowing reduced electronic current for the same volume compared to the same earbud without use of the shunt. Amplification can take place at about 20 decibels with the devices of the disclosed technology.

Figure 15:
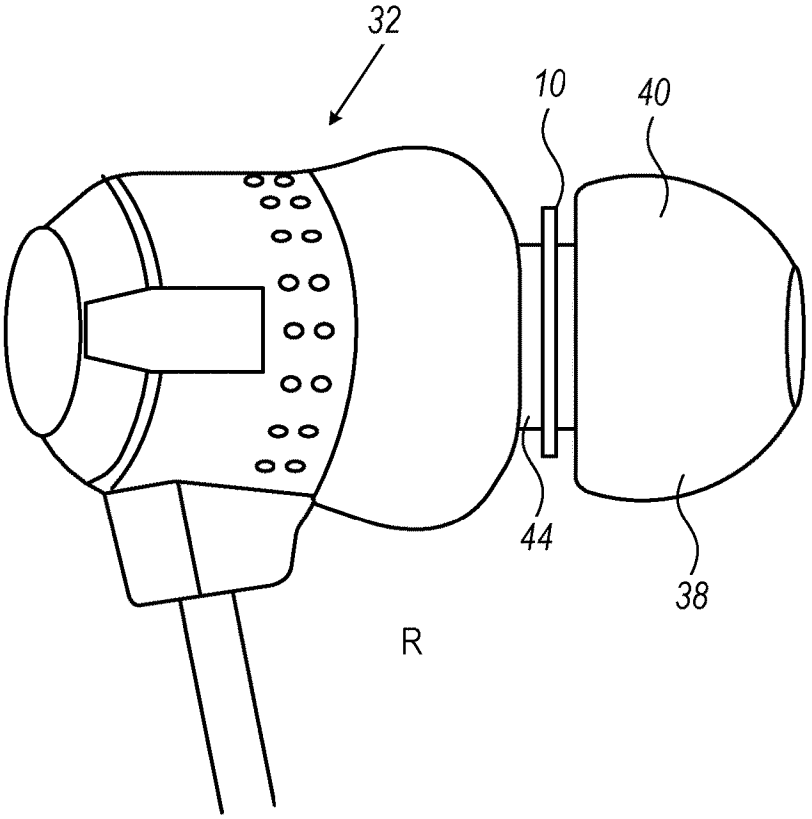
FIG. 15 shows the AMM passive impedance matching device positioned on different types of earbuds according to one embodiment of the present disclosed technology.
Figure 15:
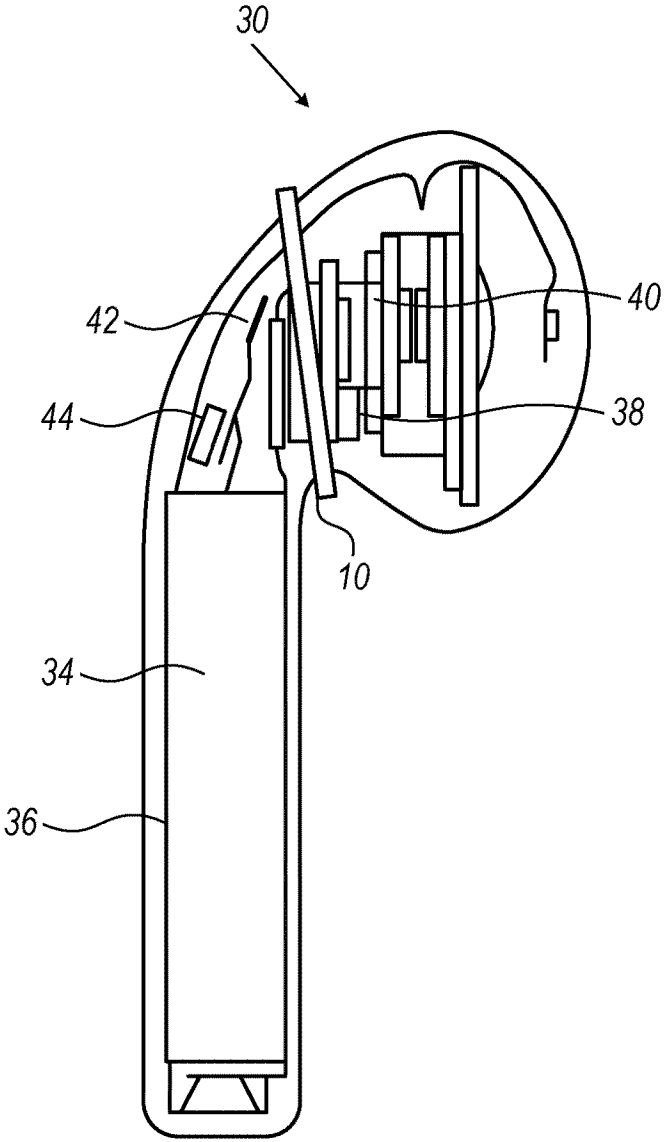

Referring to FIG. 15, FIG. 15 shows the AMM passive impedance matching device positioned on different types of ear buds 30, 32 according to one embodiment of the present disclosed technology. Different types of ear buds have various regions which are outside of the ear while in use including, for example, a spine region 34 with an antenna 36. In some embodiments, a speaker 38 with a speaker cone enters the ear canal during use. In embodiments, the speaker driver, which is within the speaker, is behind the ear canal region, such as within a front region 40, head, top region 42, or other part of the ear bud exterior to the ear canal in use. In some embodiments, all electronic devices outside of the ear canal while the air is compressed, or moved, by the speaker driver passes into the ear canal through the front region 38 of the ear bud. The front region 38 is vibrated by or passes sound waves there through due to the speaker driver. The front region 38 is a circumferential or substantially circumferential part of an ear bud between a speaker or speaker cone, and a region of the ear bud before sound enters ear canal.

Any device or step to a method described in this disclosure can comprise or consist of that which it is a part of, or the parts which make up the device or step. The term "and/or" is inclusive of the items which it joins linguistically and each item by itself.

For purposes of this disclosure, the term "substantially" is defined as "at least 95% of" the term which it modifies. Any device or aspect of the technology can "comprise" or "consist of" the item it modifies, whether explicitly written as such or otherwise. When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein above are also contemplated and within the scope of the invention.

What is claimed is:

1. An acoustic metamaterial passive impedance matching device for use in headphone-type devices to match the impedance load of a human ear on the loudspeaker driver in the headphone, comprising:

a plurality of annular shunt compliance chambers including one or more inductive channels attached to the main headphone, the plurality of shunt compliance chambers stacked concentrically with respect to one another from an upper end to a lower end, each of the shunt compliance chambers including a central region including a plurality of slits/channels extending radially inward from an inner circumference of at least one of the plurality of shunt compliance chambers, each of the shunt compliance chambers defining a predetermined volume of air; and a vent tube open at both ends thereof, wherein, the shunt compliance chambers together with the vent tube generate an acoustic resistance and reactive impedance that matches the acoustic impedance load of the human ear canal on the loudspeaker driver.

2. The acoustic metamaterial passive impedance matching device of claim 1, wherein the one or more inductive channels comprises a plurality of side connecting inductive channels vertically spaced from each other and between the plurality of shunt compliance chambers.

3. The acoustic metamaterial passive impedance matching device of claim 2, wherein the plurality of side connecting inductive channels connect plurality of volumes to the main headphone to provide a complex impedance.

4. The acoustic metamaterial passive impedance matching device of claim 3, wherein the connecting inductive channels of each of the plurality of shunt compliance chambers are disposed along a different size arc of an inner circumference of the corresponding annular shunt compliance chamber with respect to each of the other plurality of shunt compliance chambers.

5. The acoustic metamaterial passive impedance matching device of claim 4, wherein:

the quantity of side connecting inductive channels and the quantity of shunt compliance chambers are functions of the resistance and reactance on the loudspeaker driver.

6. The acoustic metamaterial passive impedance matching device of claim 5, wherein:

the dimensions of the side connecting inductive channels are a function of the reactance of the loudspeaker driver.

7. The acoustic metamaterial passive impedance matching device of claim 6, wherein each of the plurality of shunt compliance chambers decrease in diameter from the side of the loudspeaker toward the side inserted into the ear, such that the chamber furthest from the loudspeaker includes the smallest diameter and the chamber closest to the loudspeaker includes the largest diameter.

8. The acoustic metamaterial passive impedance matching device of claim 6, wherein each of the plurality of annular shunt compliance chambers have a uniform inner diameter, such that the chambers are substantially flush with one another at an inner side thereof.

9. The acoustic metamaterial passive impedance matching device of claim 1, wherein the vent tube comprises an inductive element, adapted to control broadband performance.

10. The acoustic metamaterial passive impedance matching device of claim 1, wherein the one or more inductive channels comprises:

a first set of inductive channels each having a first end attached to one of the plurality of shunt compliance chambers, and a second, open, end, distal to the one of the plurality of shunt compliance chambers; and a second set of inductive channels each having a first end attached to one of the plurality of shunt compliance chambers, and a second, closed, end, distal to the one of the plurality of shunt compliance chambers, wherein the inductive channels in the first set provide inductive reactance and the inductive channels in the second set provide capacitive reactance.

11. The acoustic metamaterial passive impedance matching device of claim 1, placed around a neck portion of an ear bud.

12. The acoustic metamaterial passive impedance matching device of claim 1, placed within a foam cup of a headphone, between an output side of a speaker and a portion of the headphone which points toward the ear canal.

13. The acoustic metamaterial passive impedance matching device of claim 1, adapted to amplify pre-designated frequency at a volume of 20 dB.

14. The acoustic metamaterial passive impedance matching device of claim 1, wherein the vent tube extends at a side of the device adapted to be closer to the ear canal.

15. An acoustic metamaterial passive impedance matching device for use in headphone-type devices to match the impedance load of a human ear on the loudspeaker driver in the headphone, comprising:

a plurality of annular shunt compliance chambers stacked concentrically with respect to one another from an upper end to a lower end, each of the shunt compliance chambers including a central region including a plurality of slits/channels extending radially inward from an inner circumference of at least one of the plurality of shunt compliance chambers, each of the shunt compliance chambers defining a predetermined volume of air;

a first set of inductive channels each having a first end attached to one of the plurality of shunt compliance chambers, and a second, open, end, distal to the one of the plurality of shunt compliance chambers; and a second set of inductive channels each having a first end attached to one of the plurality of shunt compliance chambers, and a second, closed, end, distal to the one of the plurality of shunt compliance chambers, wherein the inductive channels in the first set provide inductive reactance and the inductive channels in the second set provide capacitive reactance, and wherein, the shunt compliance chambers together with the first and second sets of inductive channels generate an acoustic resistance and reactive impedance that matches the acoustic impedance load of the human ear canal on the loudspeaker driver.

* * * * *